US010669674B2

(12) United States Patent
Olson

(10) Patent No.: US 10,669,674 B2
(45) **Date of Patent: *Jun. 2, 2020**

(54) METHOD FOR REDUCING THE BULK AND INCREASING THE DENSITY OF A TISSUE PRODUCT

(71) Applicant: GPCP IP Holdings LLC, Atlanta, GA (US)

(72) Inventor: Steven R. Olson, Menasha, WI (US)

(73) Assignee: GPCP IP Holding LLC, Atlanta, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/286,483

(22) Filed: Feb. 26, 2019

(65) Prior Publication Data

US 2019/0226152 A1 Jul. 25, 2019

Related U.S. Application Data

(63) Continuation of application No. 16/012,640, filed on Jun. 19, 2018, now Pat. No. 10,253,459, which is a (Continued)

(51) Int. Cl.
*D21H 27/02* (2006.01)
*D21H 27/40* (2006.01)
(Continued)

(52) U.S. Cl.
CPC ..... *D21H 27/02* (2013.01); *B31F 1/07* (2013.01); *D21F 11/006* (2013.01);
(Continued)

(58) Field of Classification Search
CPC ..... B31F 1/07; B31F 2201/0733; B31F 2201/0761; B31F 2201/0774;
(Continued)

(56) References Cited

U.S. PATENT DOCUMENTS 2,032,645 A 3/1936 Youtz et al.
2,216,803 A 10/1940 Benda et al.
(Continued)

FOREIGN PATENT DOCUMENTS

CN 1148878 A 4/1997
CN 102555304 A 7/2012
(Continued)

OTHER PUBLICATIONS

International Search Report and Written Opinion of the International Searching Authority that issued in counterpart International Application No. PCT/US2014/059601 dated Nov. 20, 2014.
(Continued)

*Primary Examiner* — Jose A Fortuna
(74) *Attorney, Agent, or Firm* — Laura L. Bozek

(57) ABSTRACT

A method of increasing the density and reducing the bulk of multi-ply paper products allowing one to reduce the roll size or increase the roll content, while minimizing the destruction of favorable product attributes.

17 Claims, 30 Drawing Sheets

Related U.S. Application Data continuation of application No. 15/135,971, filed on Apr. 22, 2016, now Pat. No. 10,006,172, which is a continuation of application No. 14/501,982, filed on Sep. 30, 2014, now Pat. No. 9,416,496.

(60) Provisional application No. 61/891,734, filed on Oct. 16, 2013.

(51) Int. Cl.
*D21H 27/00* (2006.01)
*B31F 1/07* (2006.01)
*D21F 11/00* (2006.01)

(52) U.S. Cl.
CPC ..... *D21H 27/002* (2013.01); *D21H 27/005* (2013.01); *D21H 27/40* (2013.01); *B31F 2201/0715* (2013.01)

(58) Field of Classification Search
CPC ..... B31F 2201/0782; D21H 27/002; D21H 27/30; D21H 27/02; D21H 27/40; B32B 38/06; A47K 10/16
See application file for complete search history.

(56) References Cited

U.S. PATENT DOCUMENTS

| | | | | |
|---|---|---|---|---|
| D131,272 | S | 2/1942 | Fixler | |
| D168,757 | S | 2/1953 | Odzer | |
| 2,890,540 | A | 6/1959 | Britt et al. | |
| 3,414,459 | A | 12/1968 | Wells | |
| 3,867,225 | A | 2/1975 | Nystrand et al. | |
| 4,376,671 | A | 3/1983 | Schulz et al. | |
| D332,876 | S | 2/1993 | Shufelt et al. | |
| 5,300,347 | A | 4/1994 | Underhill et al. | |
| D381,811 | S | 8/1997 | Du Grosriez | |
| 5,693,403 | A | 12/1997 | Brown et al. | |
| D395,955 | S | 7/1998 | Du Grosriez | |
| 5,834,099 | A | 11/1998 | Steinhardt et al. | |
| 5,900,114 | A | 5/1999 | Brown et al. | |
| 5,913,765 | A | 6/1999 | Burgess et al. | |
| 6,287,676 | B1 | 9/2001 | Ruppel et al. | |
| D450,934 | S | 11/2001 | Duritsch et al. | |
| 6,395,133 | B1 | 5/2002 | McNeil | |
| 6,681,826 | B1 | 1/2004 | Biagiotti et al. | |
| 6,913,673 | B2 | 7/2005 | Baggot et al. | |
| D554,867 | S | 11/2007 | Bianchi et al. | |
| 7,435,316 | B2 | 10/2008 | Boatman et al. | |
| 7,494,564 | B2 | 2/2009 | Basler et al. | |
| 7,524,404 | B2 | 4/2009 | Boatman et al. | |
| 7,540,939 | B2 | 6/2009 | Graff et al. | |
| 7,787,676 | B2 | 8/2010 | Drobnitzky et al. | |
| 7,871,692 | B2 | 1/2011 | Morin et al. | |
| 7,887,676 | B2 | 2/2011 | McNeil et al. | |
| 8,083,893 | B2 | 12/2011 | Boatman et al. | |
| 8,119,223 | B2 | 2/2012 | Marinoni et al. | |
| 8,163,130 | B2 | 4/2012 | Polat et al. | |
| 8,287,986 | B2 | 10/2012 | Huss et al. | |
| 8,293,072 | B2 | 10/2012 | Super et al. | |
| 8,562,329 | B2 | 10/2013 | Moslehi et al. | |
| D695,022 | S | 12/2013 | Olson et al. | |
| D704,453 | S | 5/2014 | Olson et al. | |
| D710,618 | S | 8/2014 | Olson et al. | |
| D718,540 | S | 12/2014 | Wishneski et al. | |
| 9,416,496 | B2 * | 8/2016 | Olson | D21H 27/40 |
| 9,622,625 | B2 * | 4/2017 | Maladen | A47K 10/16 |
| 9,663,900 | B2 * | 5/2017 | Jeannot | B31F 1/07 |
| 9,670,620 | B2 * | 6/2017 | Ostendorf | D21H 27/02 |
| 9,915,034 | B2 * | 3/2018 | Dwiggins | D21H 27/42 |
| 10,006,172 | B2 * | 6/2018 | Olson | D21H 27/40 |
| 10,208,427 | B2 * | 2/2019 | Sierra | D21H 27/002 |
| 10,253,459 | B2 * | 4/2019 | Olson | D21H 27/40 |
| 2003/0021953 | A1 | 1/2003 | Graff | |
| 2005/0241788 | A1 | 11/2005 | Baggot et al. | |
| 2006/0231224 | A1 | 10/2006 | Gelli et al. | |
| 2008/0245693 | A1 | 10/2008 | Vinson et al. | |
| 2009/0194244 | A1 | 8/2009 | Harper et al. | |
| 2009/0297781 | A1 | 12/2009 | Huss et al. | |
| 2011/0311345 | A1 | 12/2011 | McNeil et al. | |
| 2012/0156447 | A1 | 6/2012 | Hein et al. | |
| 2012/0244241 | A1 | 9/2012 | McNeil et al. | |
| 2012/0244320 | A1 | 9/2012 | Sauter et al. | |
| 2013/0029105 | A1 | 1/2013 | Miller et al. | |
| 2013/0323453 | A1 | 12/2013 | Hirasawa et al. | |
| 2013/0344294 | A1 | 12/2013 | Eilert et al. | |
| 2014/0044923 | A1 | 2/2014 | Gelli et al. | |
| 2014/0238596 | A1 | 8/2014 | McNeil et al. | |
| 2014/0242320 | A1 | 8/2014 | McNeil et al. | |
| 2015/0101772 | A1 | 4/2015 | Olson et al. | |
| 2016/0340834 | A1 | 11/2016 | Olson et al. | |
| 2017/0183824 | A1 | 6/2017 | McNeil | |
| 2017/0217121 | A1 | 8/2017 | Maier et al. | |
| 2017/0268174 | A1 | 9/2017 | Yamada | |
| 2017/0274616 | A1 | 9/2017 | Greenfield | |
| 2018/0298561 | A1 | 10/2018 | Olson | |
| 2019/0071823 | A1 * | 3/2019 | Ostendorf | D21H 27/005 |
| 2019/0194875 | A1 * | 6/2019 | Ostendorf | D21H 27/005 |
| 2019/0203422 | A1 * | 7/2019 | Ostendorf | B32B 3/30 |
| 2019/0226152 | A1 * | 7/2019 | Olson | B31F 1/07 |

FOREIGN PATENT DOCUMENTS

| | | | |
|---|---|---|---|
| CN | 202412807 | U | 9/2012 |
| CN | 103025513 | A | 4/2013 |
| CN | 103069076 | A | 4/2013 |
| EP | 1209289 | A1 | 5/2002 |
| EP | 1321576 | A1 | 6/2003 |
| EP | 1331308 | A1 | 7/2003 |
| EP | 1455014 | A1 | 9/2004 |
| EP | 2095935 | A1 | 9/2009 |
| EP | 1911574 | B1 | 7/2010 |
| JP | 2002369765 | A | 12/2002 |
| MX | 2012014954 | A | 2/2013 |
| WO | 9529294 | A1 | 11/1995 |
| WO | 2008107845 | A2 | 9/2008 |
| WO | 2010135270 | A1 | 11/2010 |
| WO | 2011159792 | A2 | 12/2011 |

OTHER PUBLICATIONS

International Preliminary Report on Patentability (Chapter I) that issued in counterpart International Application No. PCT/US2014/059601 dated Apr. 28, 2016.

Extended European Search Report that issued in European patent application No. 14854566.8 dated Mar. 14, 2017.

* cited by examiner

METHOD FOR REDUCING THE BULK AND INCREASING THE DENSITY OF A TISSUE PRODUCT

CROSS-REFERENCE TO RELATED APPLICATION

This non-provisional application is based upon U.S. patent application Ser. No. 16/012,640 filed Jun. 19, 2018, now U.S. Pat. No. 10,253,459, which is a continuation of Ser. No. 15/135,971 filed Apr. 22, 2016, now U.S. Pat. No. 10,006,172, which is a continuation of U.S. Pat. No. 9,416,496 issued on Aug. 16, 2016 which is based upon U.S. Provisional Patent Application No. 61/891,734, filed Oct. 16, 2013, which is incorporated herein by reference in its entirety.

BACKGROUND OF THE INVENTION

The present invention addresses a recent need in the consumer product industry regarding the increasing size of premium paper goods, e.g., tissue and towel, and concurrently their packages. As papermaking techniques have improved and the industry has moved to structured base sheets, the attributes of tissue and towel have improved. These improvements are seen in characteristics like softness, bulk, and absorbency of the paper, among others. However, concurrent with these improvements, the tissue plies have also become thicker making rolls of paper, e.g., towels and bathroom tissue, larger. These larger rolls require additional space to store and ship. In addition, while the roll products have gotten larger, consumer carriers have not. Consumers neither wish to change the size of their bathroom tissue or paper towel holders nor do they want to receive smaller rolls containing less paper product. Therefore, a need exists for a paper product that has reduced bulk and increased density that can achieve the consumer's desired size without either requiring reduction of the amount of product or compromising the properties of the paper product.

SUMMARY OF THE INVENTION

This disclosure provides a method of increasing the density and reducing the bulk of paper products, thus allowing one to reduce the roll size or increase the roll content of a product made from that paper, while minimizing impact on favorable product attributes. Specifically, the method of this disclosure uses a substantially linear emboss pattern which decreases the bulk of the product without interfering with important consumer characteristics such as strength and absorbency. This disclosure further relates to the paper products having increased density and reduced bulk made by this method. According to one embodiment, this disclosure provides a method of embossing and plying a multi-ply product.

Products such as paper towels, bathroom tissue, facial tissues, napkins, wipers, and like products, are typically made from one or more webs of nonwoven paper. For the products to perform as expected by the consumer, the webs from which these products are formed generally exhibit favorable characteristics of strength, softness, and absorbency. Strength is the ability of a paper web to retain its physical integrity during use. Softness is the pleasing tactile sensation the consumer perceives as the consumer uses the paper product. Absorbency is the characteristic of the paper web which allows it to take up and retain fluids. Typically, the softness and/or absorbency of a paper web increases at the expense of the strength of the paper web. Consumer testing of products having embossed surfaces show that consumers prefer soft products with relatively high caliper (thickness) and exhibiting aesthetically pleasing decorative patterns. The products of the instant disclosure achieve all of the consumer's desired attributes while having a reduced bulk.

Processes for the manufacture of wet-laid paper products generally involve the preparation of an aqueous slurry of cellulosic fibers and subsequent removal of water from the slurry while rearranging the fibers to form a web. Various types of machinery can be employed to assist in the dewatering process. A typical manufacturing process employs, for example, a Fourdrinier wire papermaking machine where a paper slurry is fed onto a surface of a traveling endless wire where the initial dewatering occurs. In a conventional wet press process, the fibers are transferred directly to a capillary de-watering belt where additional de-watering occurs. In a structured web process, the fibrous web is subsequently transferred to a papermaking belt where rearrangement and drying of the fibers is carried out.

As paper production has moved from conventional wet pressing to through air drying (TAD) and other methods for making structured base sheets, for example, using a perforated polymeric belt as described in U.S. Pat. No. 8,293,072, the tissue base sheets have seen improvements in many sheet characteristics including strength, softness, bulk, and absorbency. As the caliper of these structured base sheets has increased, either package size has increased or the sheet count has been reduced. A need exists for a reduced bulk premium paper product exhibiting uncompromised quality which would mirror current commercial products in size and sheet count. Heretofore, embossing and plying were routinely carried out to increase and improve the bulk and absorbency of a paper product. Embossing is known to increase the bulk of the product to which it is applied. It is therefore surprising that an embossing pattern made up of substantially linear elements can be used to emboss, or emboss and ply, a premium paper product without compromising quality but resulting in an end product having a caliper lower than the caliper of the nonwoven web(s) from which it is made.

Additional objects and advantages of the invention will be set forth in part in the description which follows, and in part will be obvious from the description, or may be learned by practice of the invention. The objects and advantages of the invention will be realized and attained by means of the elements and combinations particularly pointed out in the appended claims.

It is to be understood that both the foregoing general description and the following detailed description are exemplary and explanatory only and are not restrictive of the invention, as claimed. The accompanying drawings, which are incorporated in and constitute a part of this specification, illustrate several embodiments of the invention and together with the description, serve to explain the principles of the invention.

DETAILED DESCRIPTION OF THE INVENTION

Figure 1A:
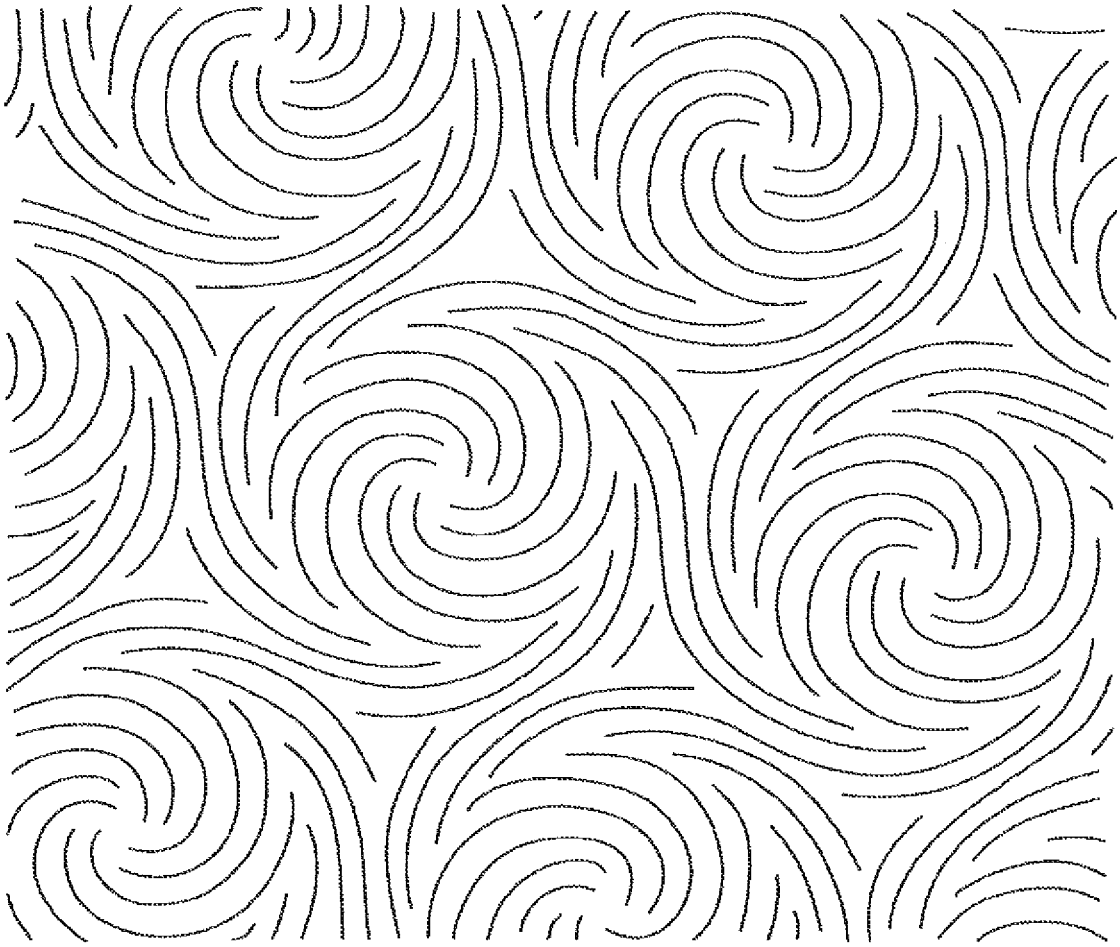
FIGS. 1A and 1B illustrate an emboss pattern that can be used in the method according to the invention, and its counterpart non-linear dot representation, respectively.

As used herein, the terms "paper web," "web," "paper sheet," "fibrous structure," "nonwoven web," and "paper product" are all used interchangeably to refer to sheets of paper products suitable for consumer use in, for example, paper toweling, bath tissue, napkins, facial tissue, wipers and the like. Products of the disclosure can be any paper product in which the bulk and density of the product would benefit from reduction and in which it is important that softness, absorbency and strength not be substantially negatively affected. Products contemplated for production using the disclosed embossing method can be in the areas of tissue and towel, feminine hygiene, adult incontinence and baby products, including, for example, baby wipes or diapers. The paper products as described can be in the form of, for example, stacks or rolls. In one embodiment, the paper products as described may be wound with or without a core to form a rolled paper product. Rolled products may comprise a plurality of connected and perforated sheets that are separable and dispensable from adjacent sheets.

The paper of the present invention may comprise papermaking fibers of both hardwoods and softwoods pulps. "Hardwood pulps" as used herein refers to fibrous pulp derived from the woody substance of deciduous trees (angiosperms). "Softwood pulps" are fibrous pulps derived from the woody substance of coniferous trees (gymnosperms). Blends of hardwood and softwood are also suitable to produce the paper products as described. In one embodiment the plies of the paper product may be heterogeneous web layers. In another embodiment, the plies may be non-heterogeneous or stratified. Also applicable to the present invention are fibers derived from recycled paper, which may contain any or all of the above categories of fibers. According to yet another embodiment, the fibers may include one or more non-wood based fiber. Wood pulps useful herein include chemical pulps such as, sulfite and sulfate (sometimes called Kraft) pulps as well as mechanical pulps including for example, ground wood, ThermoMechanical Pulp (TMP) and Chemi-ThermoMechanical Pulp (CTMP).

Paper products of the present disclosure may be produced according to any art recognized wet laid or air laid method. According to one embodiment, the paper product as described is made from one or more base sheet(s) chosen from conventional wet press (CWP) base sheet(s), structured base sheet(s) including both TAD and e-TAD, air laid base sheet(s) and combinations thereof.

Any art recognized process for making the base sheet(s) is suitable for use in the present invention. Typically, depending upon the desired end use, paper products are generally comprised of papermaking fibers and small amounts of chemical functional agents such as wet strength or dry strength agents, binders, retention aids, surfactants, size, chemical softeners, and release agents. Additionally, filler materials may also be incorporated into the web. All such base sheets may be used in the method described in the instant disclosure.

The paper product of the present invention may exhibit a basis weight of from about 20 $g/m^2$ to about 120 $g/m^2$, for example, from about 30 $g/m^2$ to about 65 $g/m^2$, for example, from about 37 $g/m^2$ to about 50 $g/m^2$.

Paper products as described are embossed. "Embossed" as used herein with respect to a fibrous web means a fibrous web that has been subjected to a process which converts a smooth surfaced fibrous web to a decorative surface by replicating a design on one or more emboss rolls, which form a nip through which the fibrous web passes. Embossed does not include creping, microcreping, printing or other processes that may impart a texture and/or decorative pattern to a fibrous structure.

During a typical embossing process, a web is fed through a nip formed between juxtaposed generally axially parallel rolls. Embossing elements on the rolls compress and/or deform the web. If a multi-ply product is being formed, two or more webs, i.e., plies, are fed through the nip and regions of each ply are brought into a contacting relationship with the opposing ply. The embossed regions of the plies produce an aesthetic pattern and may provide a means for joining and maintaining the plies in face-to-face contacting relationship.

Generally, the embossing apparatus will include one or more rolls having protuberances and/or depressions formed therein. A corresponding backup roll presses the web against the embossing roll such that the embossed pattern is imparted to the web as it passes between the nip formed between the embossing roll and the backup roll. Any art recognized embossing configuration can be used in the method of the present disclosure.

While fiber-to-steel, steel-to-steel or rubber-to-rubber embossing operations can be used, the most common embossing configuration is rubber-to-steel. In rubber-to-steel embossing, the steel embossing roll is provided with protuberances and/or depressions and the web is pressed against the embossing roll by a rubber backing roll as the web passes through the nip formed between the rubber and the steel rolls. The rubber backing roll accommodates the protuberances and/or depressions by virtue of its resilience and the rubber flows about the protuberances and/or depressions as force is applied to urge the rolls together. An alternative rubber-to-steel configuration is a mated configuration. This configuration mates a steel embossing roll having a plurality of protuberances extending therefrom with a patterned rubber backing roll which urges the fibrous web substrate against the embossing roll thereby imparting a highly defined embossed pattern to the paper substrate for forming paper towels, napkins or tissues. As the paper substrate passes through the nip between the rolls, the web is forced about the protuberances and against the land areas of the steel roll, as well as into the indentations and outer peripheral surfaces of the rubber roll. As a result, a highly defined embossed pattern is provided. According to one embodiment of the invention, the embossing operation is a rubber to steel configuration.

The paper products as disclosed bear an emboss pattern that comprises linear embossments. A linear embossment is characterized by having a total embossment length to total embossment width (or an aspect ratio) of at least about 5. Smaller, embossments having an aspect ratio of less than 5 are referred to herein as dot embossments; however they can take any shape. According to one embodiment, linear embossments make up at least about 80% of the embossments on the paper product, for example, at least about 90%, for example at least about 95%. According to one embodiment, the emboss pattern is made up solely (100%) of linear emboss elements.

According to one embodiment, the linear emboss elements have an aspect ratio of at least about 5, for example, at least about 10, for example, at least about 20, for example, at least about 30, for example, at least about 40, for example, at least about 50.

According to another embodiment, the depth of embossments are from about 1.25 to about 3.5 times the caliper of the unembossed base sheet(s), for example, about 1.5 to about 2.5 times, for example, from about 1.5 to about 2.0. In the embodiment where two plies are used, this is sufficient to maintain good ply lamination with a consumer preferred appearance while reducing the finished product caliper to something less than the expected caliper of the two unembossed plies combined. This allows for the production of high performance structured base sheet products with a higher finished product density. Embossing depths for use in the present invention are generally at least about 30 mils (762 μm), for example, at least about 35 mils (889 μm), for example, at least about 40 mils (1016 μm) at least about 45 mils (1143 μm), for example, at least about 50 mils (1270 μm). As described herein embossing depth corresponds to the height of the majority elements on the emboss roll.

Without wishing to be bound by theory, we believe the linear elements, coupled with the defined depth of embossment provide more surface area, which minimizes the impact on sheet properties while resulting in an aesthetically pleasing product that can be packaged in the desired size, e.g., wound to the desired roll size, without giving up sheet count.

According to one embodiment, the embossments cover greater than about 22%, for example, from about 22 to about 50%, for example, from about 25 to about 50%, for example about 22 to about 30% of the total area of the finished product.

A multitude of combinations of emboss coverage, emboss depth, emboss aspect ratio and percent linear embosses would be apparent to the skilled artisan. The combinations set forth below are merely exemplary.

According to one embodiment, the paper products bearing the linear emboss pattern exhibit at least about 1% less caliper than the base sheet(s), for example, at least about 1.5% less caliper, for example, at least about 2% less caliper, for example, at least about 2.5% less caliper, for example, at least about 3% less caliper, for example at least about 3.5% less caliper, for example, at least about 4% less caliper, for example, at least about 4.5%, for example, at least about 5% less caliper.

TABLE 1

| Emboss Coverage (%) | Emboss Depth (mils) | Emboss Aspect Ratio of linear embossments and percentage of linear embossments at that Aspect ratio | Percent of overall pattern that is made up of linear embossments |
|---|---|---|---|
| 22 to 50 | At least 35 | At least 5 - 100% | At least 80 |
| 22 to 50 | At least 40 | At least 5 - 100% | At least 80 |
| 22 to 50 | At least 45 | At least 5 - 100% | At least 80 |
| 22 to 50 | At least 55 | At least 5 - 100% | At least 80 |
| 22 to 50 | At least 35 | At least 5 - 100% | At least 90 |
| 22 to 50 | At least 40 | At least 5 - 100% | At least 90 |
| 22 to 50 | At least 45 | At least 5 - 100% | At least 90 |
| 22 to 50 | At least 55 | At least 5 - 100% | At least 90 |
| 22 to 50 | At least 35 | At least 5 - 100% | 100 |
| 22 to 50 | At least 40 | At least 5 - 100% | 100 |
| 22 to 50 | At least 45 | At least 5 - 100% | 100 |
| 22 to 50 | At least 55 | At least 5 - 100% | 100 |
| 22 to 50 | At least 35 | At least 10 - 100% | At least 80 |
| 22 to 50 | At least 40 | At least 10 - 100% | At least 80 |
| 22 to 50 | At least 45 | At least 10 - 100% | At least 80 |
| 22 to 50 | At least 55 | At least 10 - 100% | At least 80 |
| 22 to 50 | At least 35 | At least 10 - 100% | At least 90 |
| 22 to 50 | At least 40 | At least 10 - 100% | At least 90 |
| 22 to 50 | At least 45 | At least 10 - 100% | At least 90 |
| 22 to 50 | At least 55 | At least 10 - 100% | At least 90 |
| 22 to 50 | At least 35 | At least 10 - 100% | 100 |
| 22 to 50 | At least 40 | At least 10 - 100% | 100 |
| 22 to 50 | At least 45 | At least 10 - 100% | 100 |
| 22 to 50 | At least 55 | At least 10 - 100% | 100 |
| 22 to 50 | At least 35 | At least 20 - 100% | At least 80 |
| 22 to 50 | At least 40 | At least 20 - 100% | At least 80 |
| 22 to 50 | At least 45 | At least 20 - 100% | At least 80 |
| 22 to 50 | At least 55 | At least 20 - 100% | At least 80 |
| 22 to 50 | At least 35 | At least 20 - at least 80% | At least 80 |
| 22 to 50 | At least 40 | At least 20 - at least 80% | At least 80 |
| 22 to 50 | At least 45 | At least 20 - at least 80% | At least 80 |
| 22 to 50 | At least 55 | At least 20 - at least 80% | At least 80 |
| 22 to 50 | At least 35 | At least 30 - at least 50% | At least 80 |
| 22 to 50 | At least 40 | At least 30 - at least 50% | At least 80 |
| 22 to 50 | At least 45 | At least 30 - at least 50% | At least 80 |
| 22 to 50 | At least 55 | At least 30 - at least 50% | At least 80 |
| 22 to 50 | At least 35 | At least 30 - at least 50% | At least 90 |
| 22 to 50 | At least 40 | At least 30 - at least 50% | At least 90 |
| 22 to 50 | At least 45 | At least 30 - at least 50% | At least 90 |
| 22 to 50 | At least 55 | At least 30 - at least 50% | At least 90 |
| 22 to 50 | At least 35 | At least 20 - at least 80% | At least 95 |
| 22 to 50 | At least 40 | At least 20 - at least 80% | At least 95 |
| 22 to 50 | At least 45 | At least 20 - at least 80% | At least 95 |
| 22 to 50 | At least 55 | At least 20 - at least 80% | At least 95 |
| 22 to 50 | At least 35 | At least 40 - at least 50% | At least 80 |
| 22 to 50 | At least 40 | At least 40 - at least 50% | At least 80 |
| 22 to 50 | At least 45 | At least 40 - at least 50% | At least 80 |
| 22 to 50 | At least 55 | At least 40 - at least 50% | At least 80 |
| 22 to 50 | At least 35 | At least 40 - at least 50% | At least 90 |
| 22 to 50 | At least 40 | At least 40 - at least 50% | At least 90 |
| 22 to 50 | At least 45 | At least 40 - at least 50% | At least 90 |
| 22 to 50 | At least 55 | At least 40 - at least 50% | At least 90 |
| 22 to 50 | At least 35 | At least 20 - at least 50% | 100 |
| 22 to 50 | At least 40 | At least 20 - at least 50% | 100 |
| 22 to 50 | At least 45 | At least 20 - at least 50% | 100 |
| 22 to 50 | At least 55 | At least 20 - at least 50% | 100 |
| 22 to 50 | At least 35 | At least 30 - at least 50% | 100 |
| 22 to 50 | At least 40 | At least 30 - at least 50% | 100 |
| 22 to 50 | At least 45 | At least 30 - at least 50% | 100 |
| 22 to 50 | At least 55 | At least 30 - at least 50% | 100 |
| 22 to 50 | At least 35 | At least 40 - at least 50% | 100 |
| 22 to 50 | At least 40 | At least 40 - at least 50% | 100 |
| 22 to 50 | At least 45 | At least 40 - at least 50% | 100 |
| 22 to 50 | At least 55 | At least 40 - at least 50% | 100 |
| 22 to 30 | At least 35 | At least 10 - at least 50% | 100 |
| 22 to 30 | At least 40 | At least 10 - at least 50% | 100 |
| 22 to 30 | At least 45 | At least 10 - at least 50% | 100 |
| 22 to 30 | At least 55 | At least 10 - at least 50% | 100 |
| 22 to 30 | At least 35 | At least 20 - at least 50% | 100 |
| 22 to 30 | At least 40 | At least 20 - at least 50% | 100 |
| 22 to 30 | At least 45 | At least 20 - at least 50% | 100 |
| 22 to 30 | At least 55 | At least 20 - at least 50% | 100 |
| 22 to 30 | At least 35 | At least 30 - at least 50% | 100 |
| 22 to 30 | At least 40 | At least 30 - at least 50% | 100 |

TABLE 1-continued

| Emboss Coverage (%) | Emboss Depth (mils) | Emboss Aspect Ratio of linear embossments and percentage of linear embossments at that Aspect ratio | Percent of overall pattern that is made up of linear embossments |
|---|---|---|---|
| 22 to 30 | At least 45 | At least 30 - at least 50% | 100 |
| 22 to 30 | At least 55 | At least 30 - at least 50% | 100 |
| 22 to 30 | At least 35 | At least 40 - at least 50% | 100 |
| 22 to 30 | At least 40 | At least 40 - at least 50% | 100 |
| 22 to 30 | At least 45 | At least 40 - at least 50% | 100 |
| 22 to 30 | At least 55 | At least 40 - at least 50% | 100 |

As seen from table above, the emboss configuration may vary. So, according to the first embodiment set forth in the table above, the paper product would have 22 to 50% of its surface covered with embossments that are at least 35 mils high and where linear embossments make up at least 80% of the total embossments and 100% of the linear embossments have an aspect ratio of at least 5. And, according to the last embodiment set forth in the table above, the paper product would have 22 to 30% of its surface covered with embossments that are at least 55 mils high and where linear embossments make up 100% of the total embossments and at least 50% of the linear embossments have an aspect ratio of at least 40.

Figure 1B:
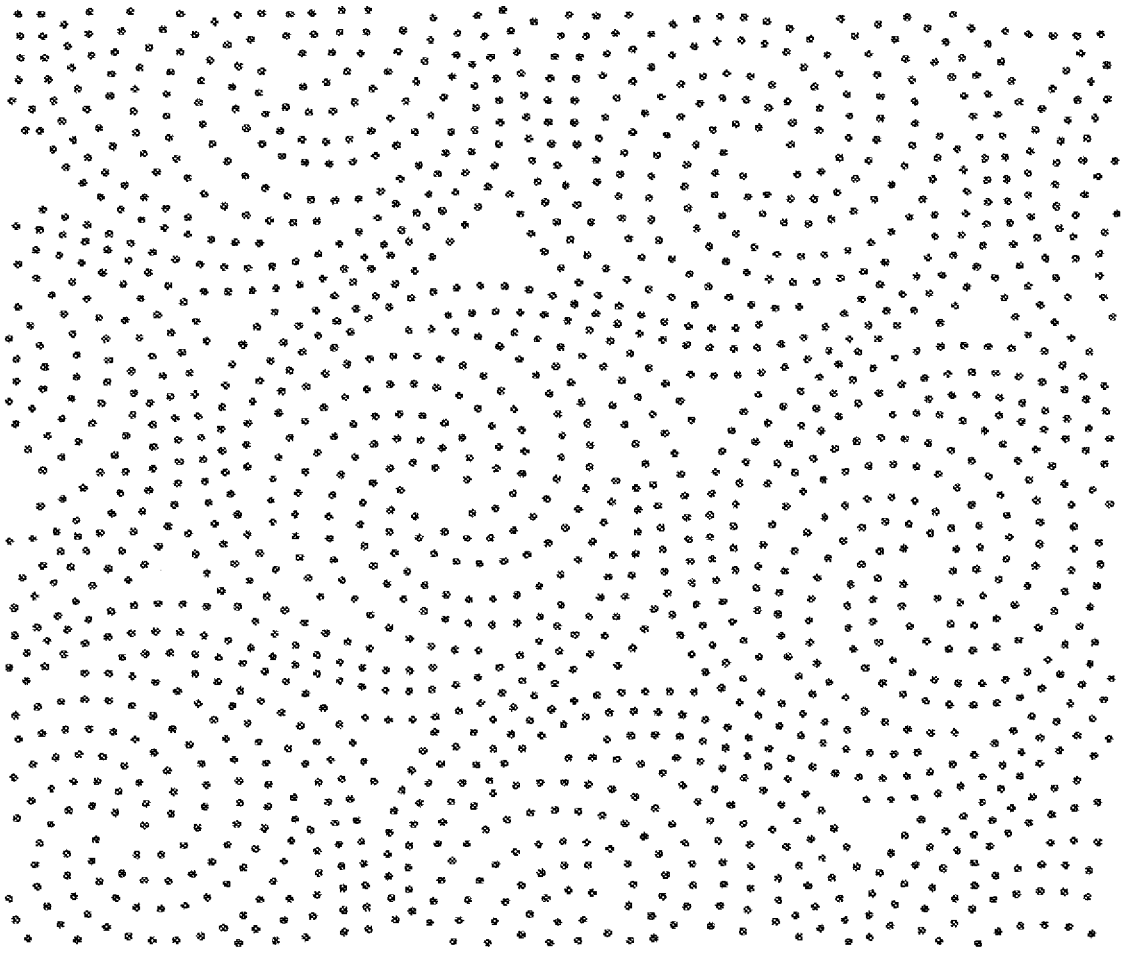
Figure 2A:
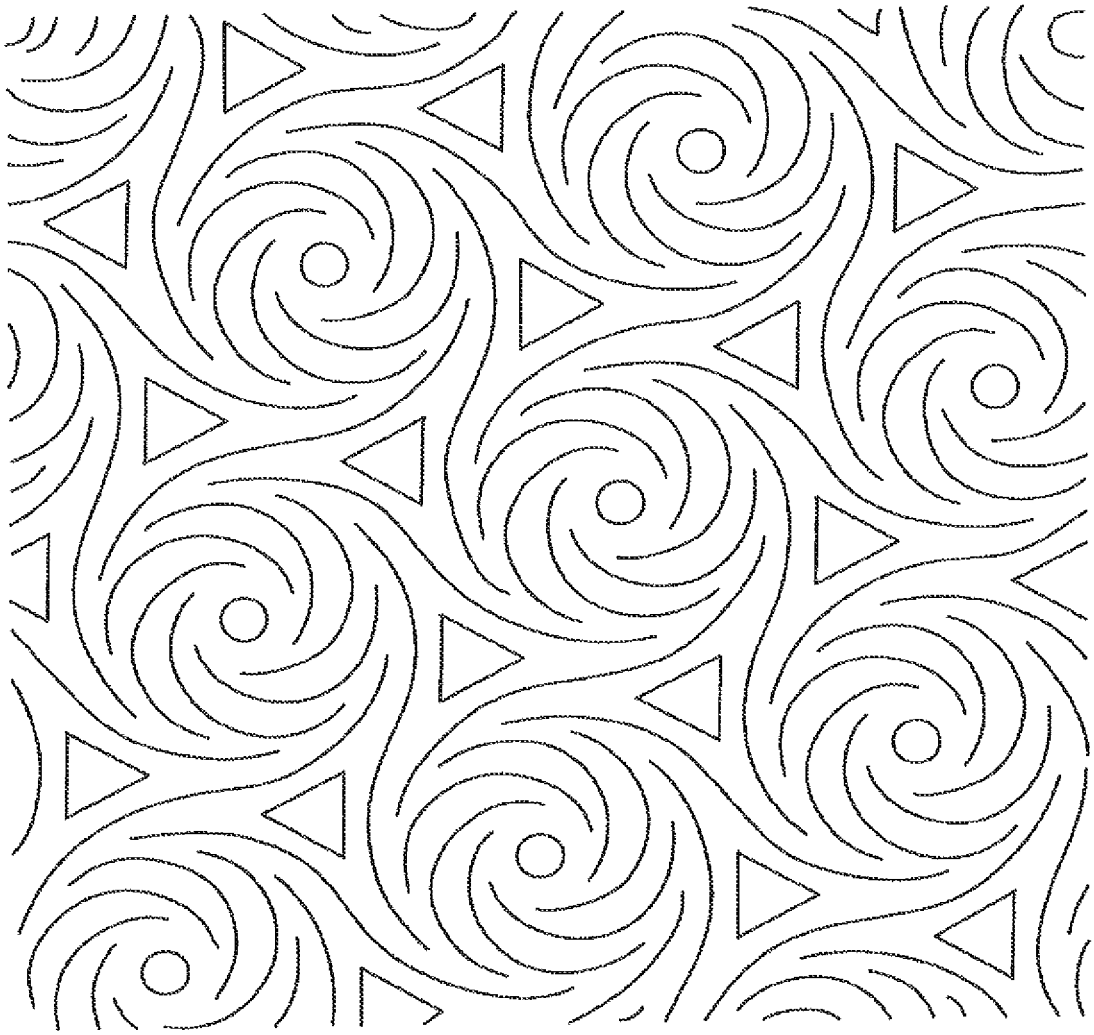
FIGS. 2A and 2B illustrate an emboss pattern that can be used in the method according to the invention, and its counterpart non-linear dot representation, respectively.
Figure 2B:
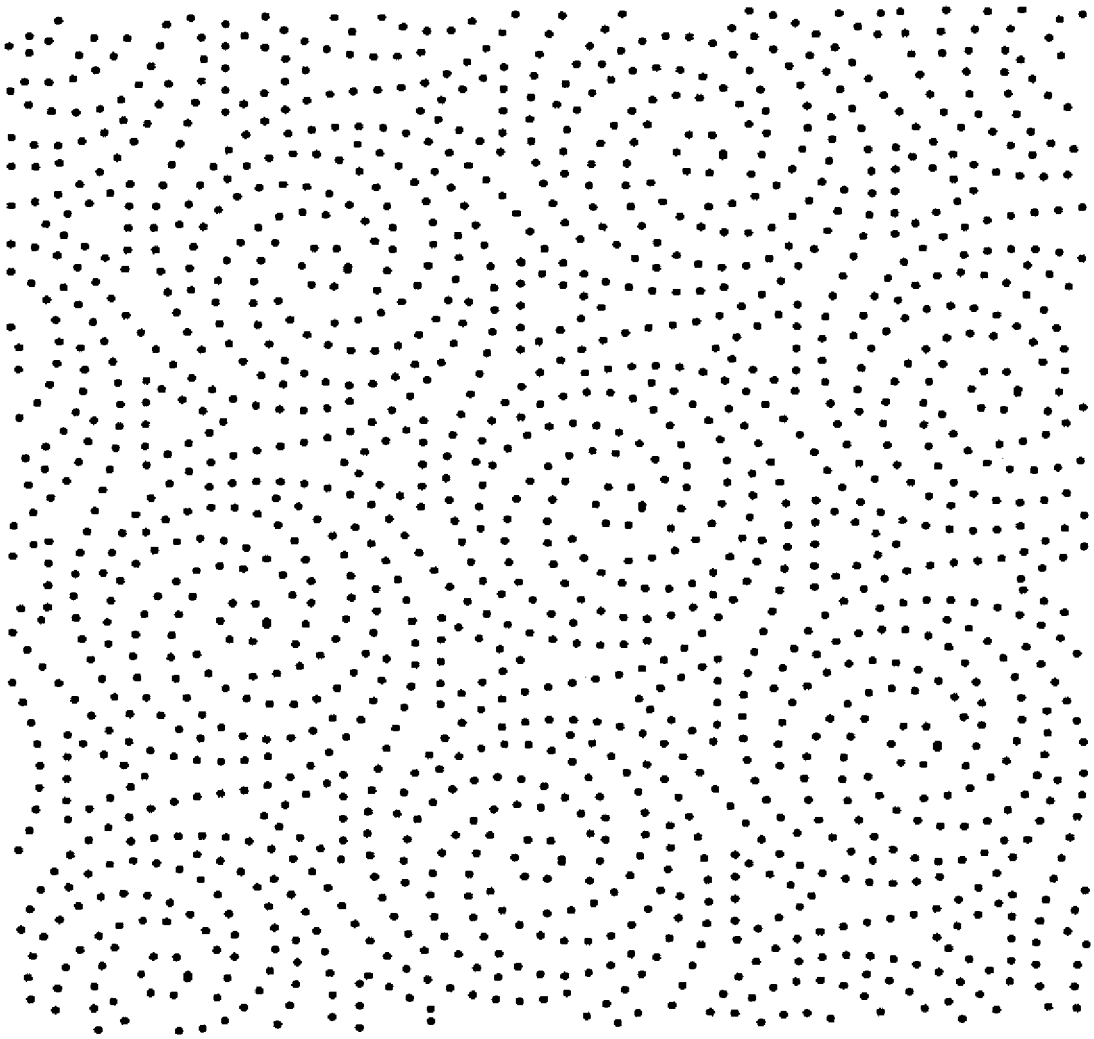
Figure 3A:
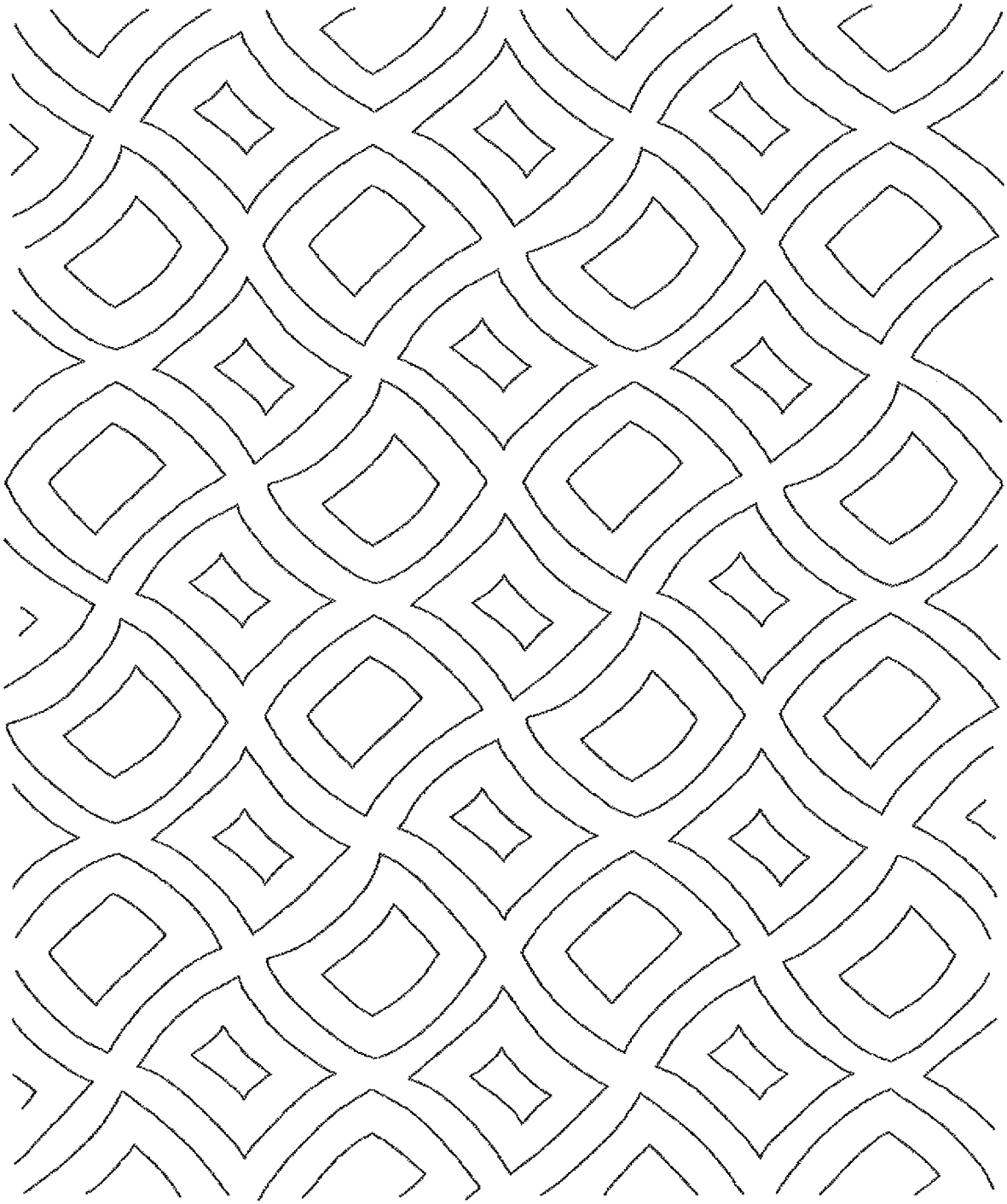
FIGS. 3A and 3B illustrate an emboss pattern that can be used in the method according to the invention, and its counterpart non-linear dot representation, respectively.
Figure 3B:
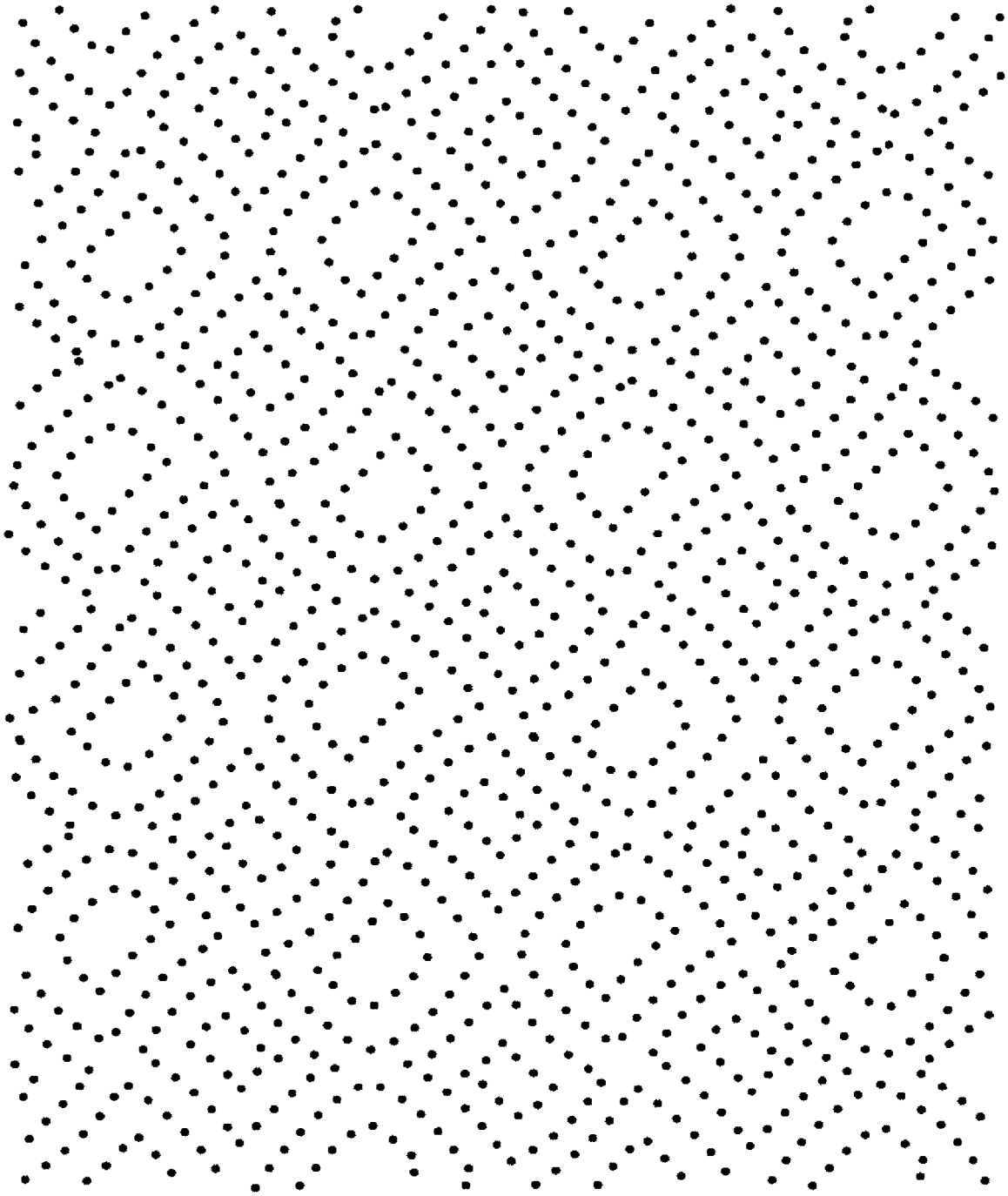
Figure 4A:
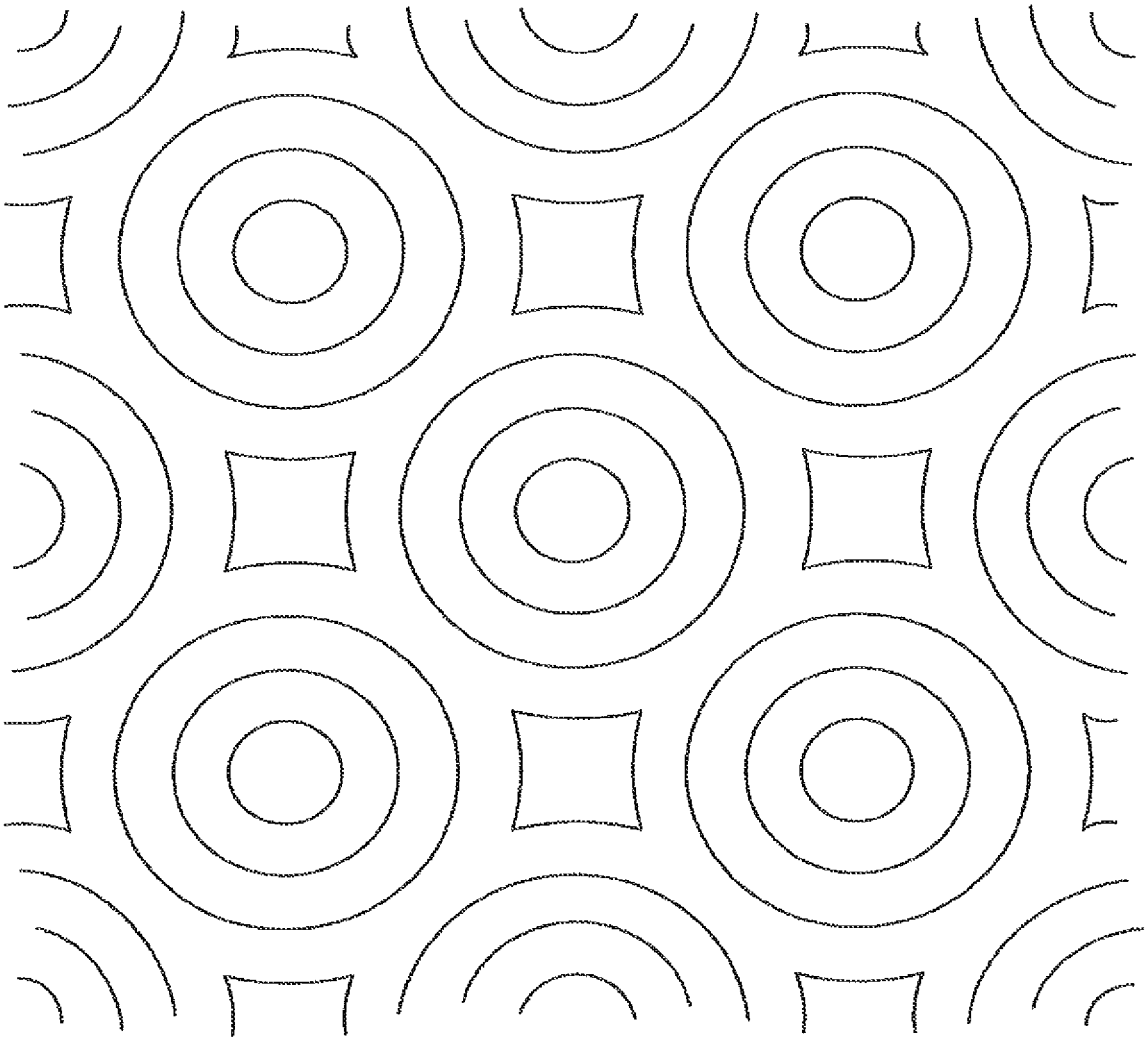
FIGS. 4A and 4B illustrate an emboss pattern that can be used in the method according to the invention, and its counterpart non-linear dot representation, respectively.
Figure 4B:
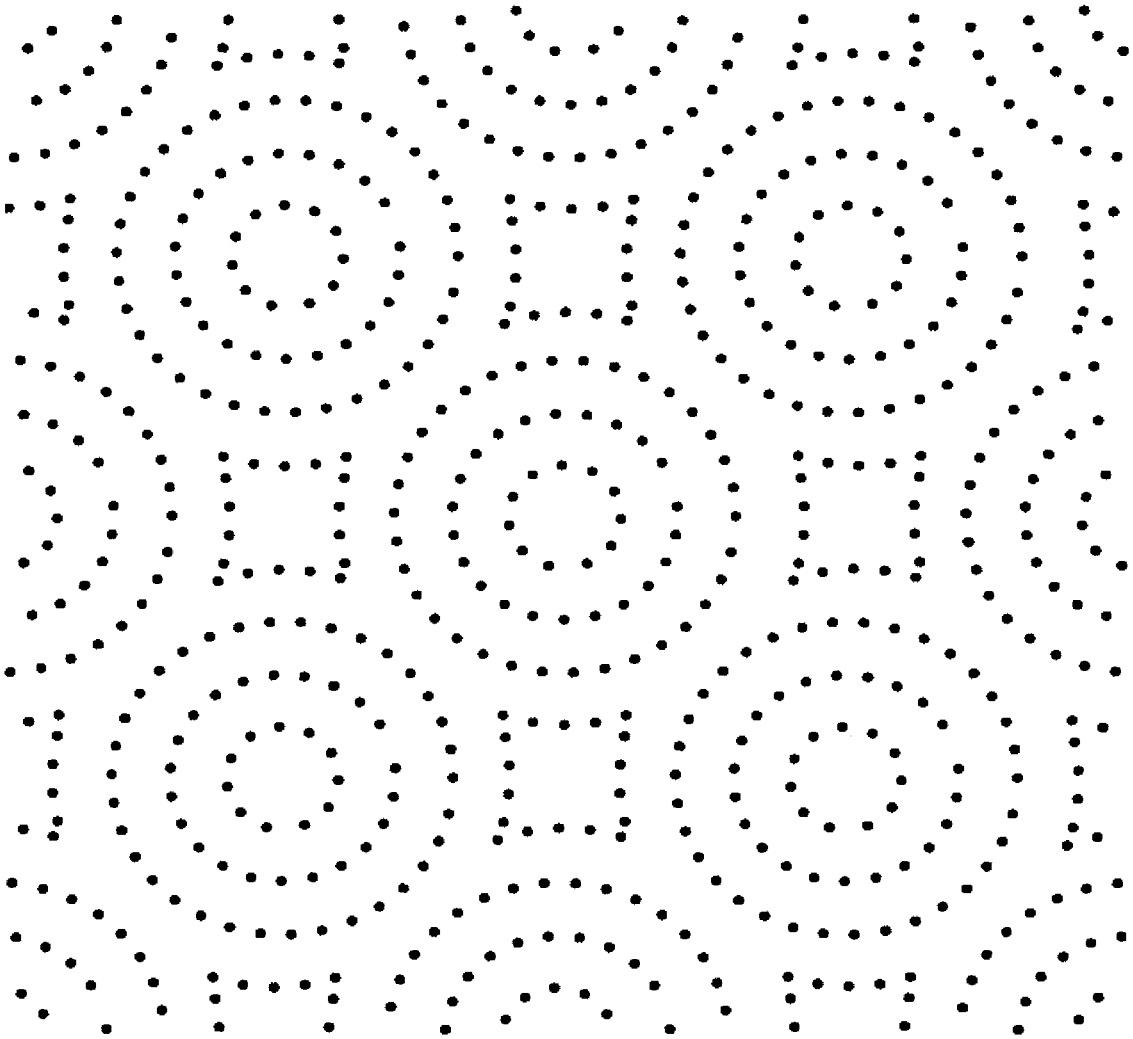

According to one embodiment, the paper products bearing the linear emboss pattern exhibit at least about 5% less caliper than the same pattern formed from dots (See, FIG. 1A versus FIG. 1B). According to another embodiment the paper products bearing the linear emboss pattern exhibit at least about 6% less caliper than the same pattern formed from dots, for example, at least about 8% less caliper, for example at least, about 10% less caliper, for example, at least about 12% less caliper.

Figure 9:
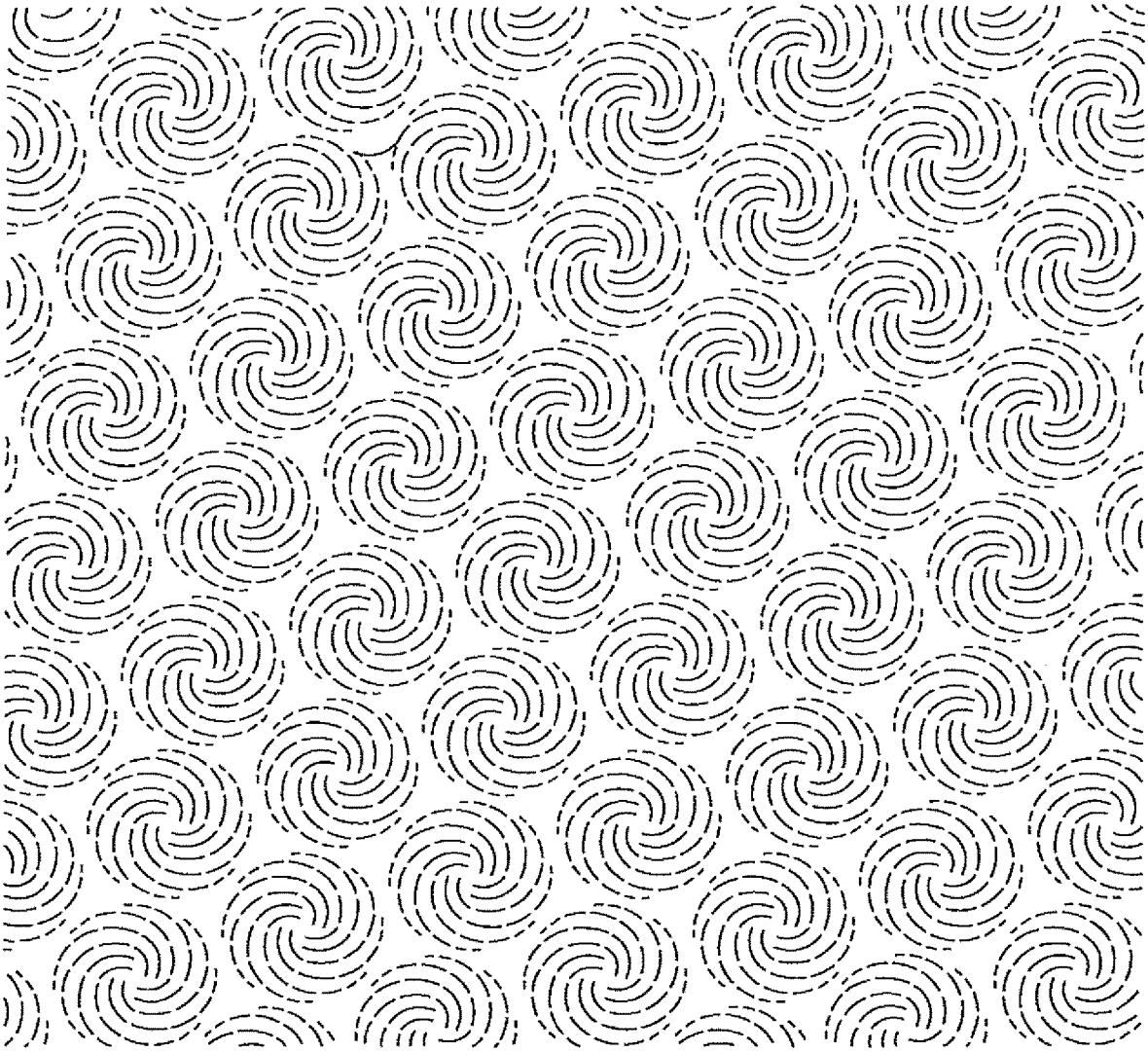
FIG. 9 illustrates an emboss pattern that can be used in the method according to the invention.
Figure 10:
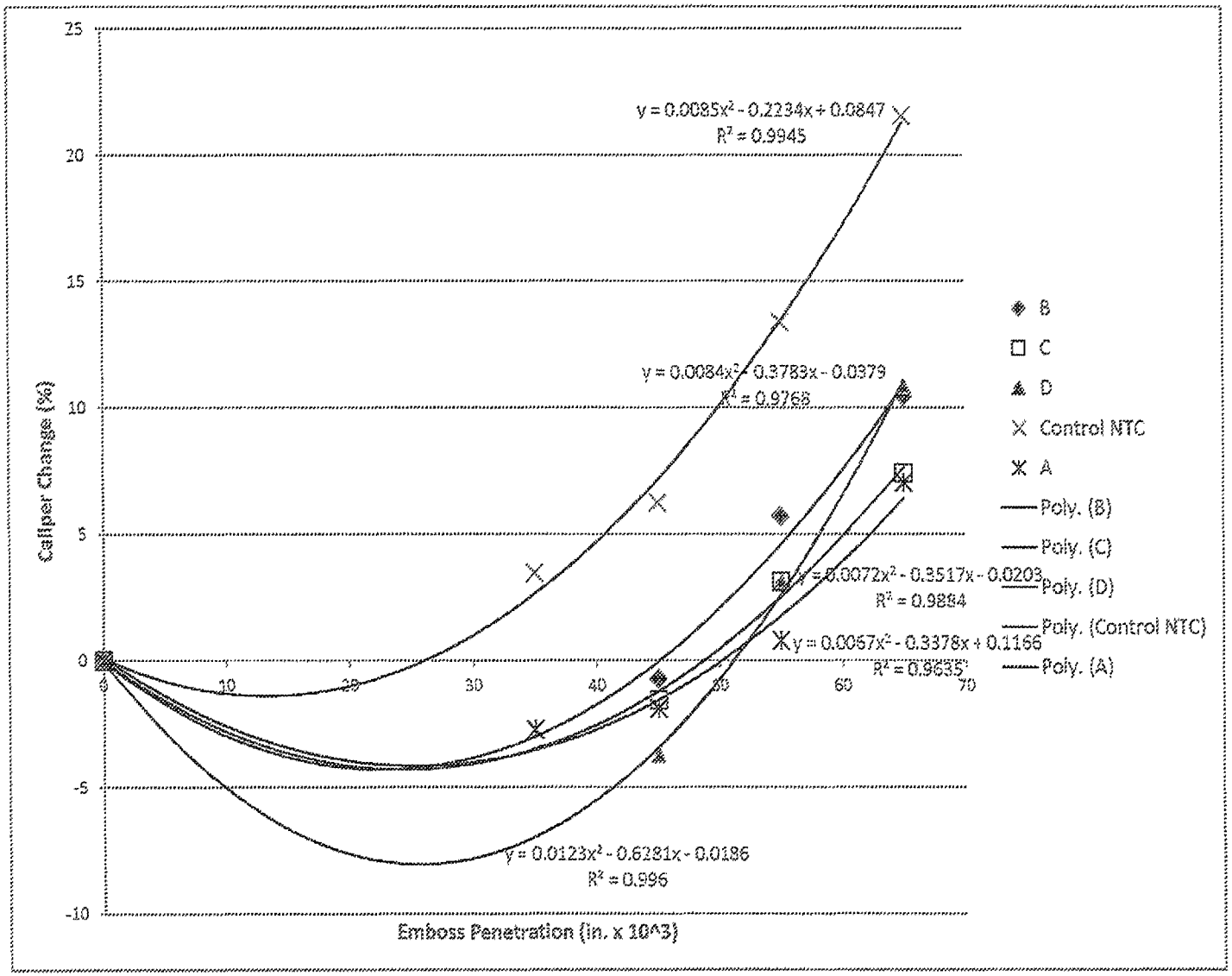
FIGS. 10 to 22 are graphical representations based upon the data presented in Example 2.
Figure 11:
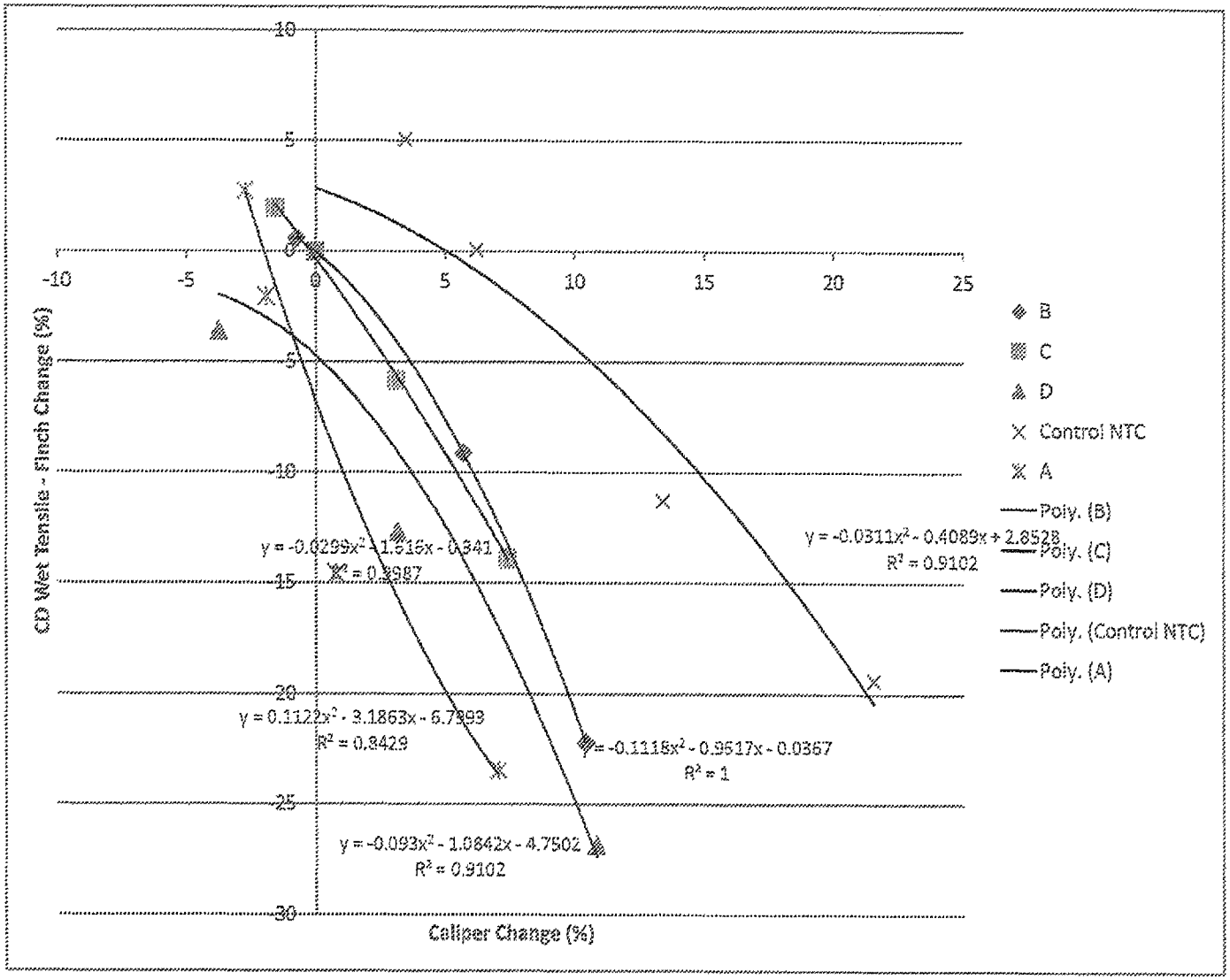
Figure 12:
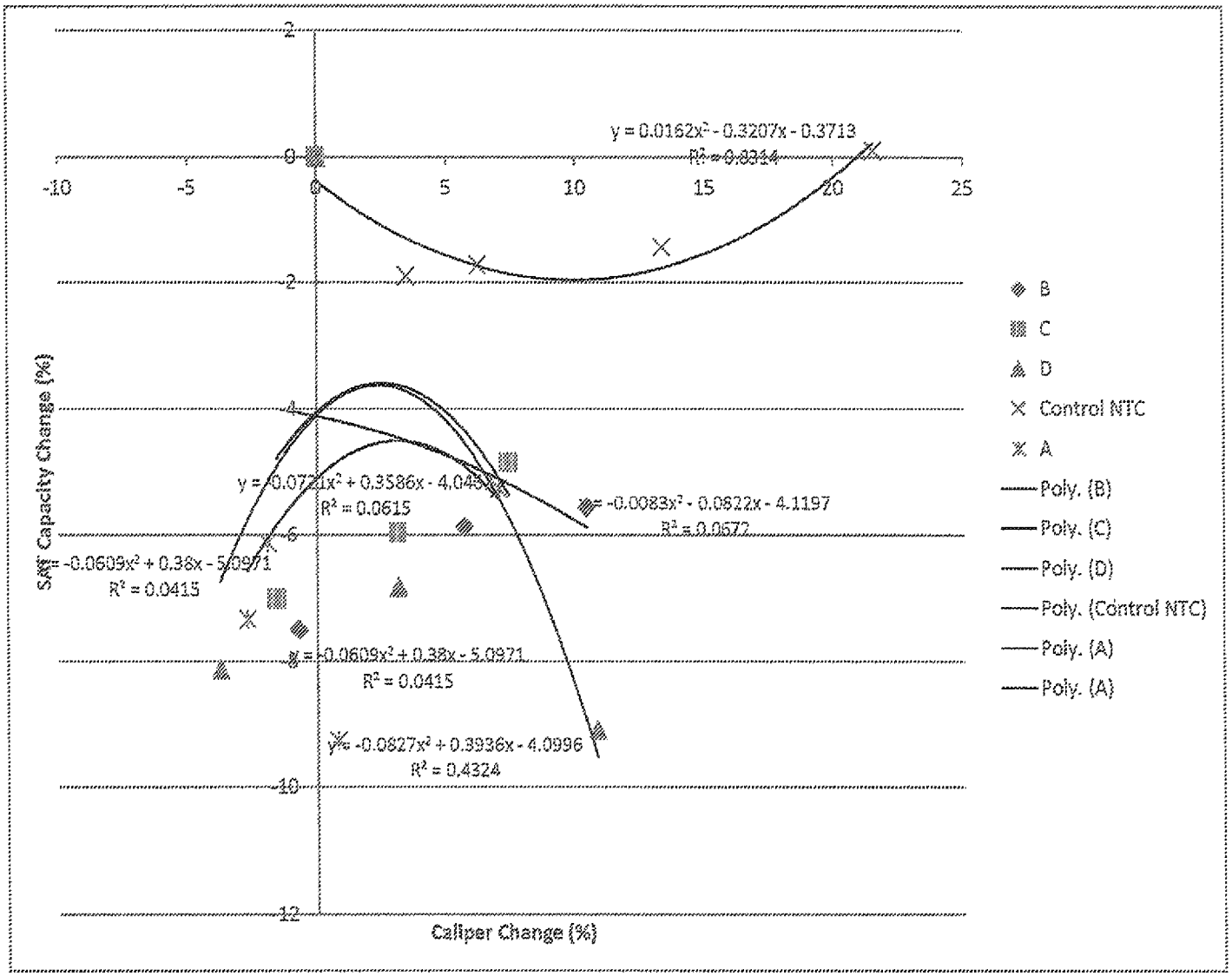
Figure 13:
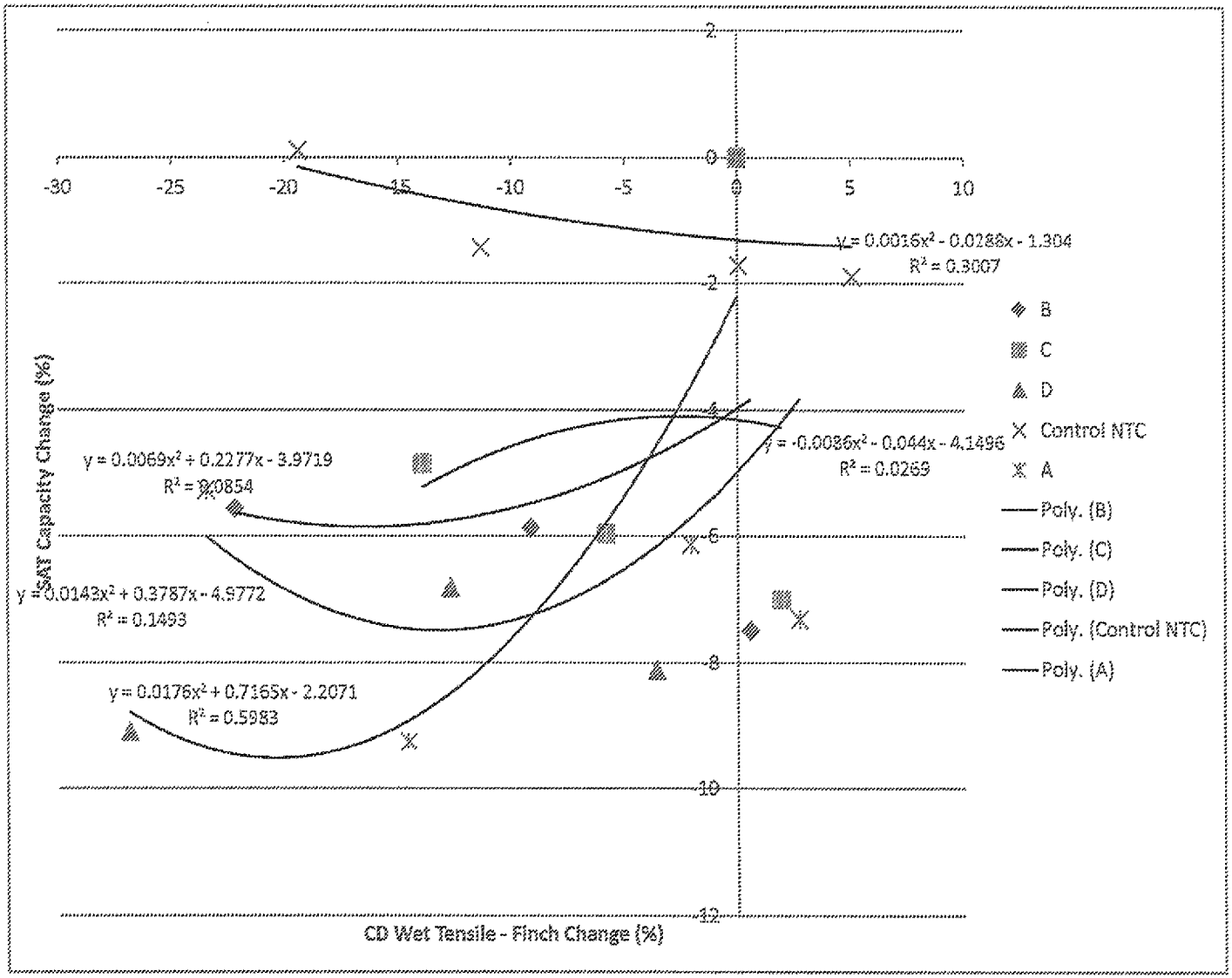
Figure 14:
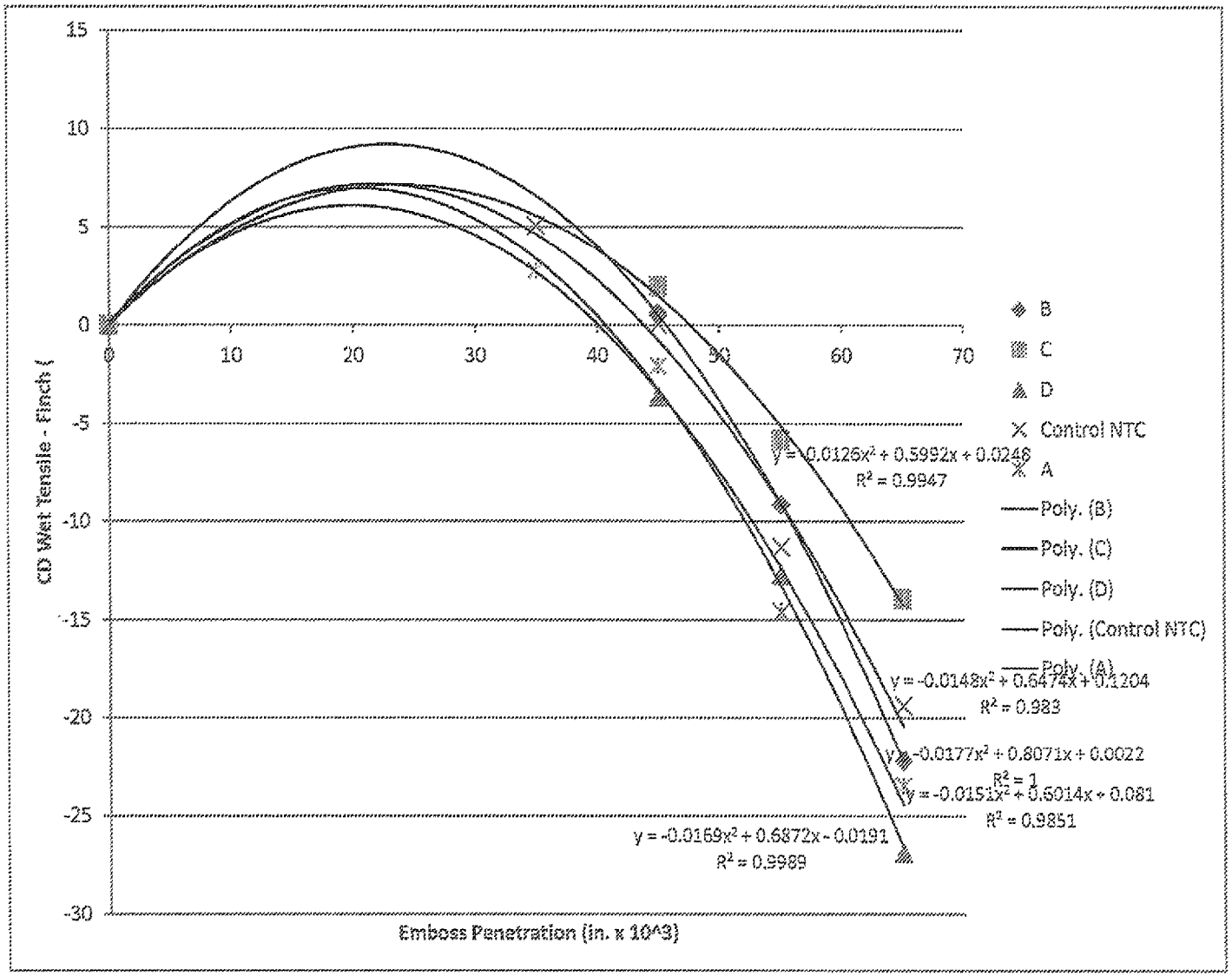
Figure 15:
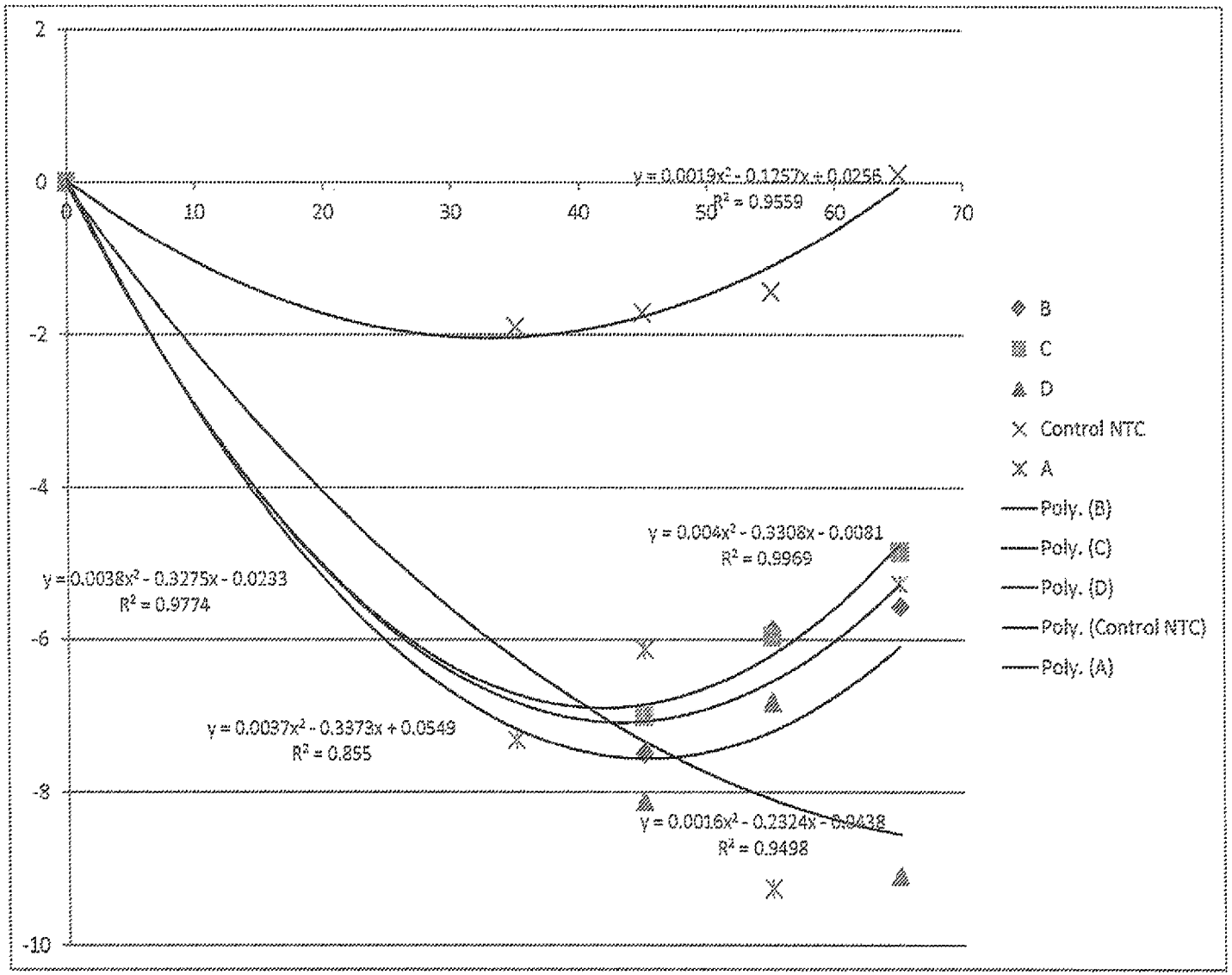
Figure 16:
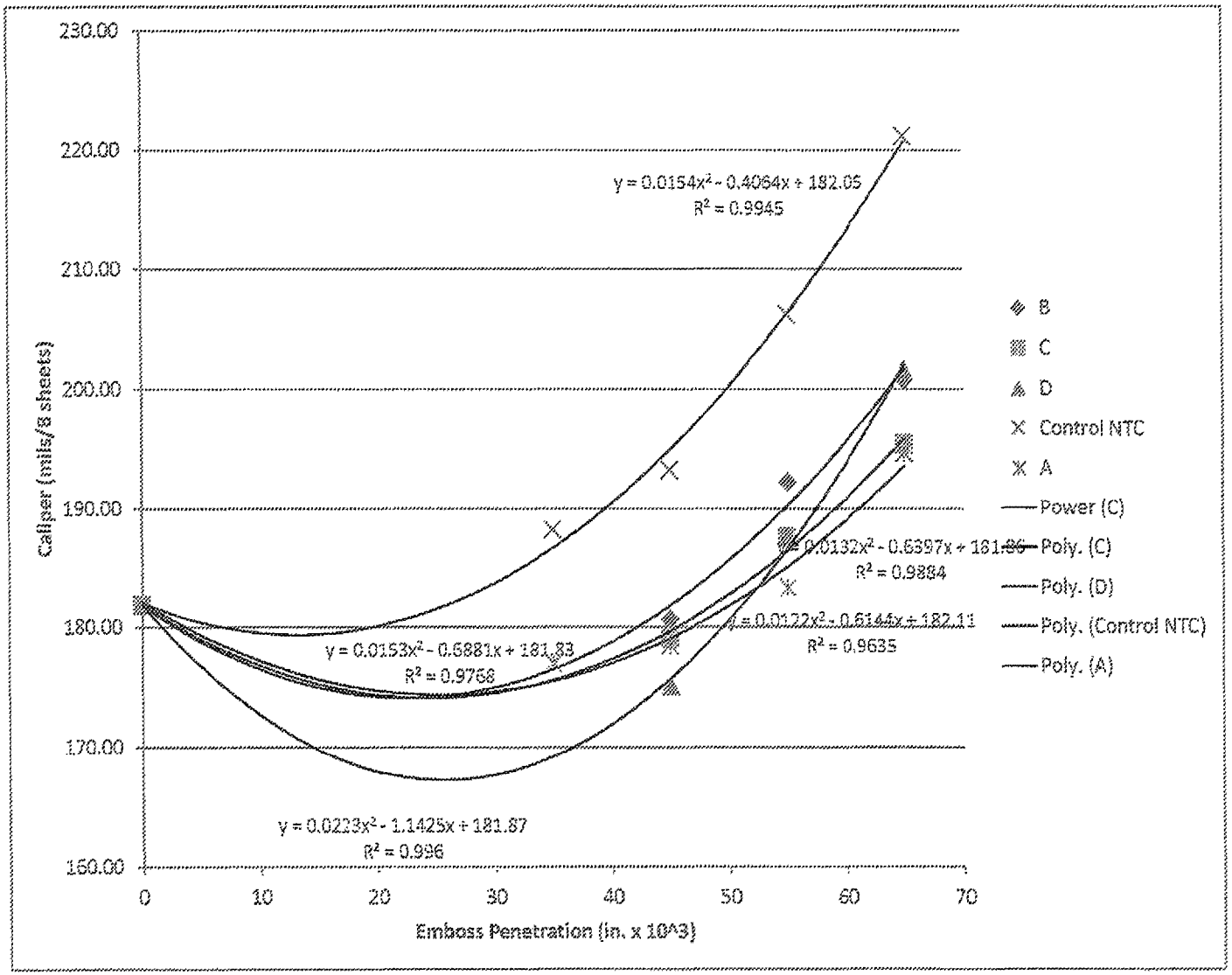
Figure 17:
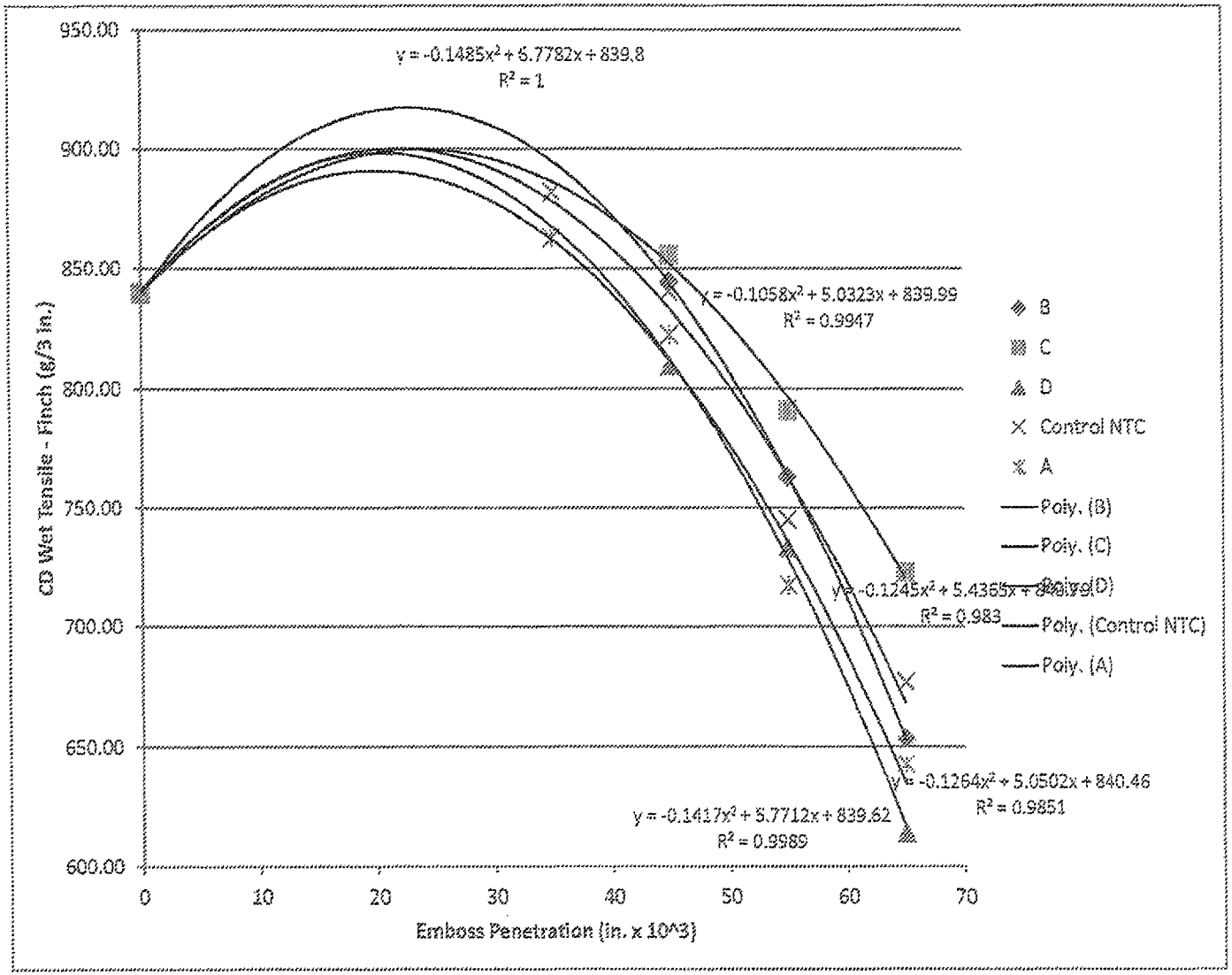
Figure 18:
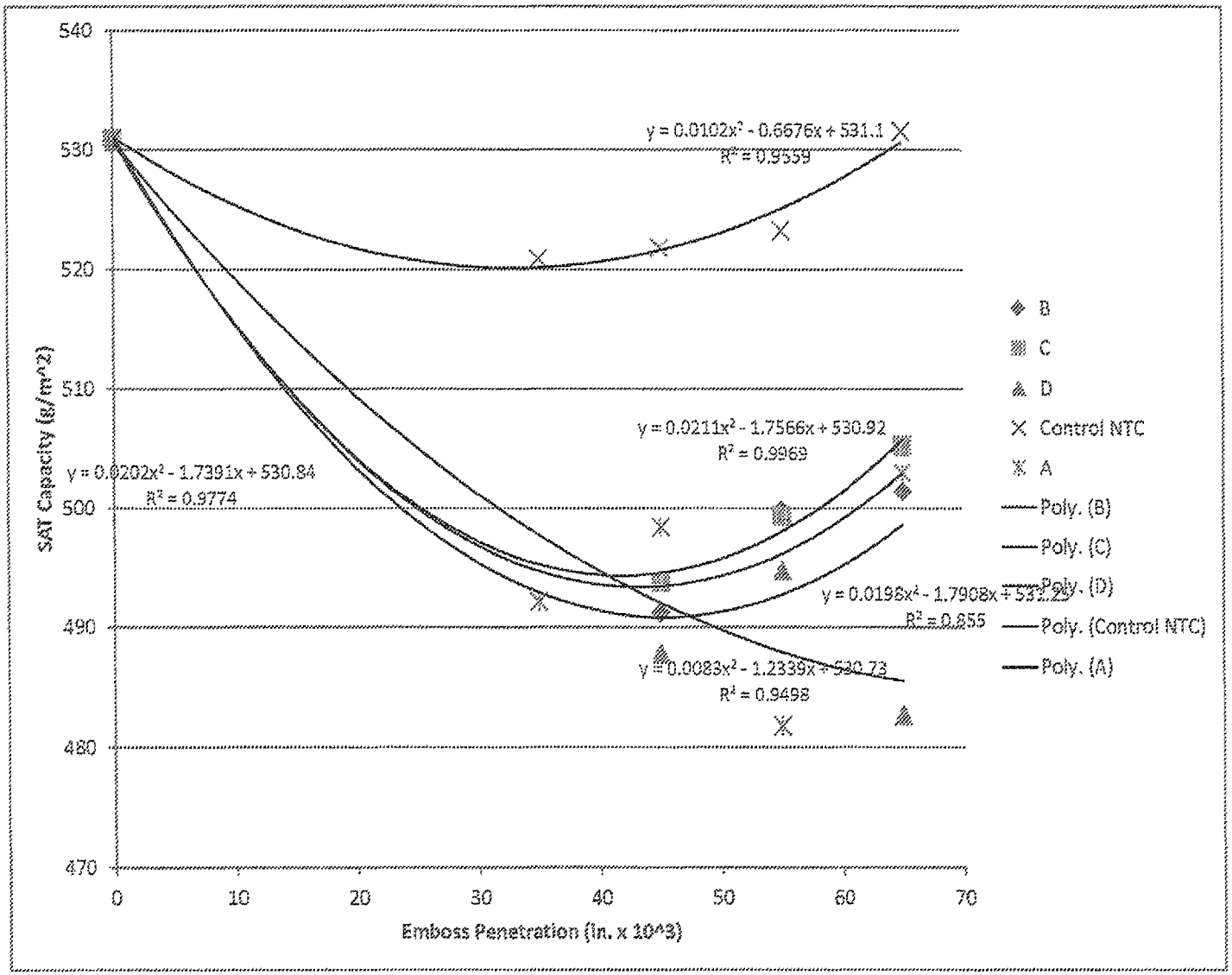
Figure 19:
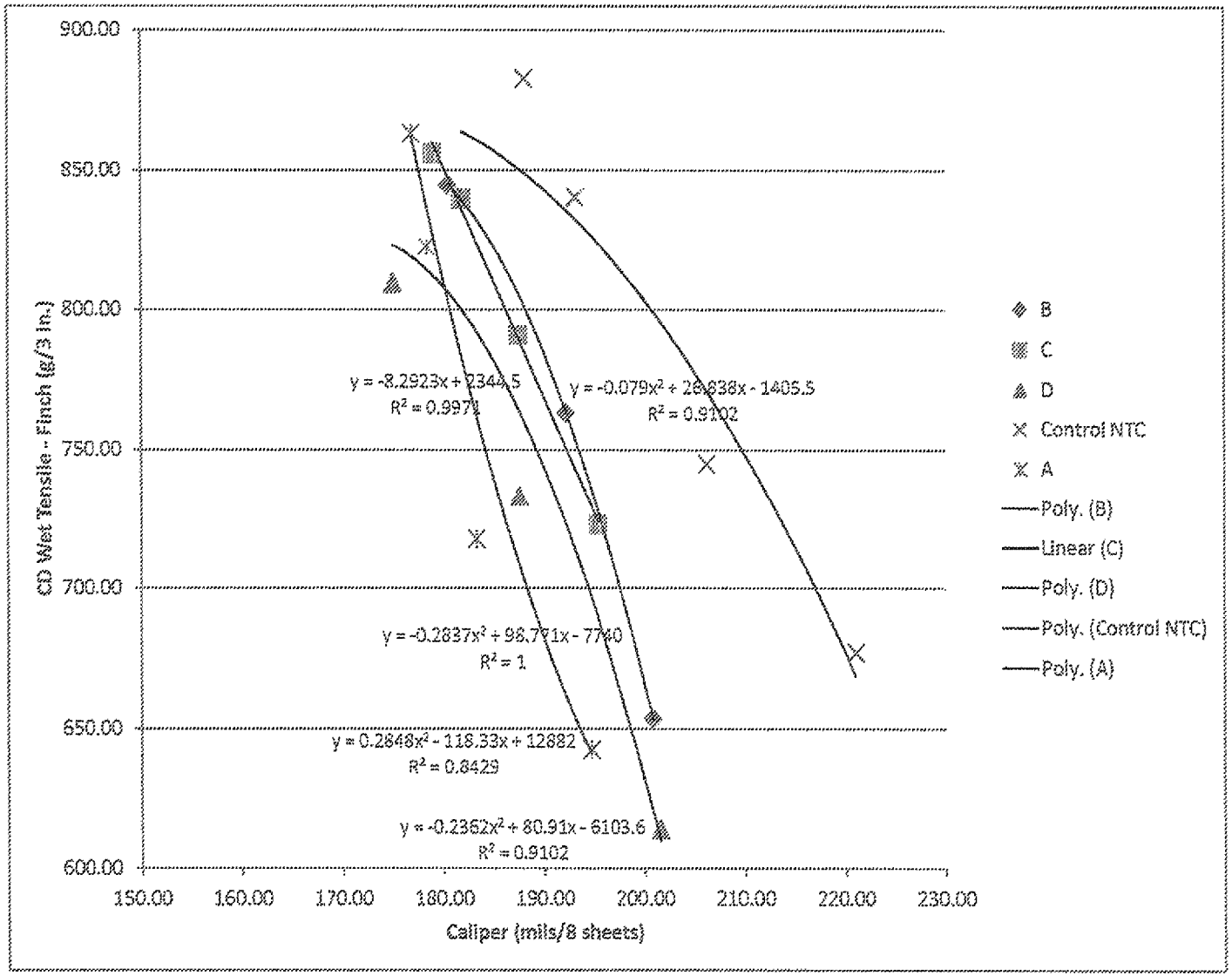
Figure 20:
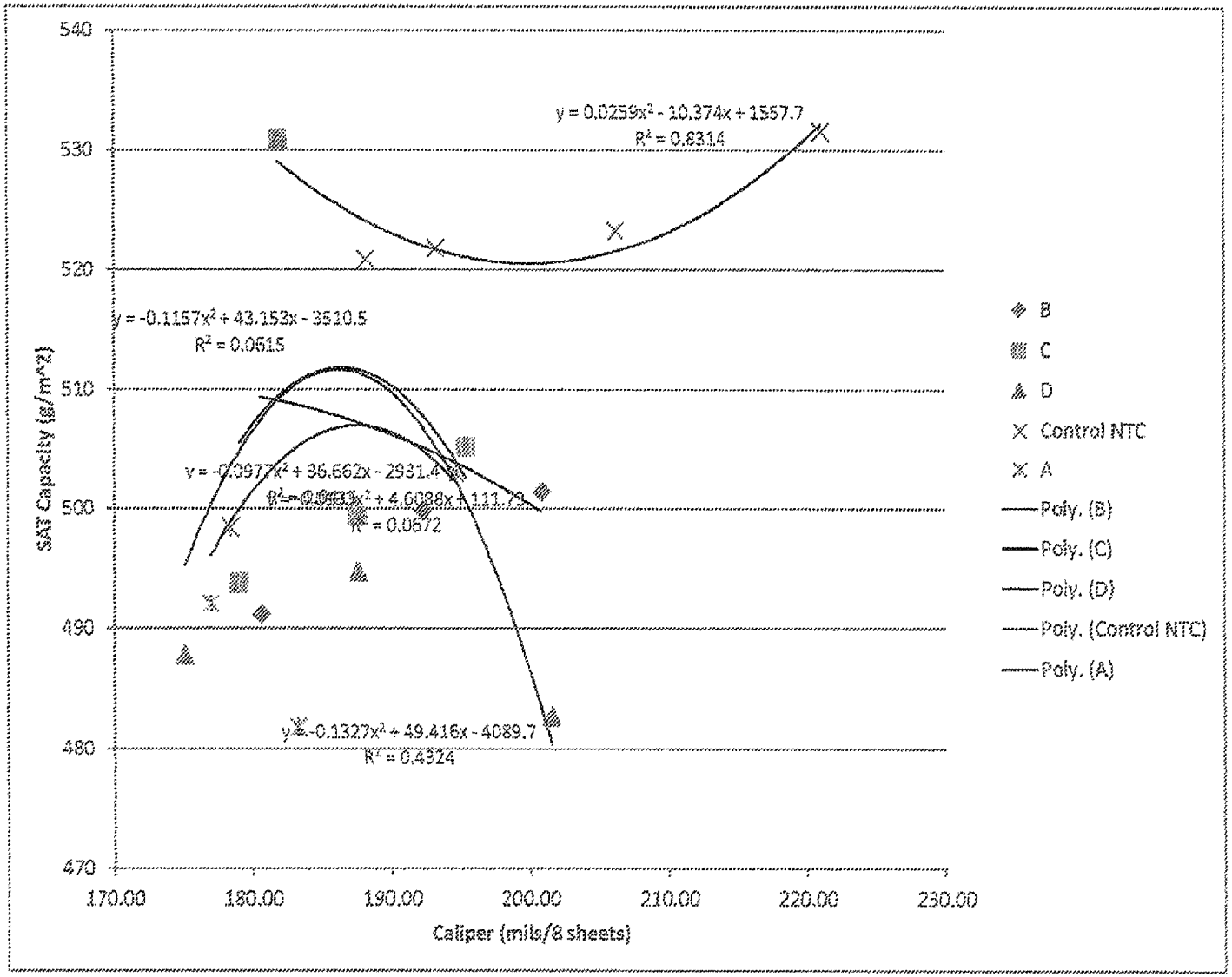
Figure 21:
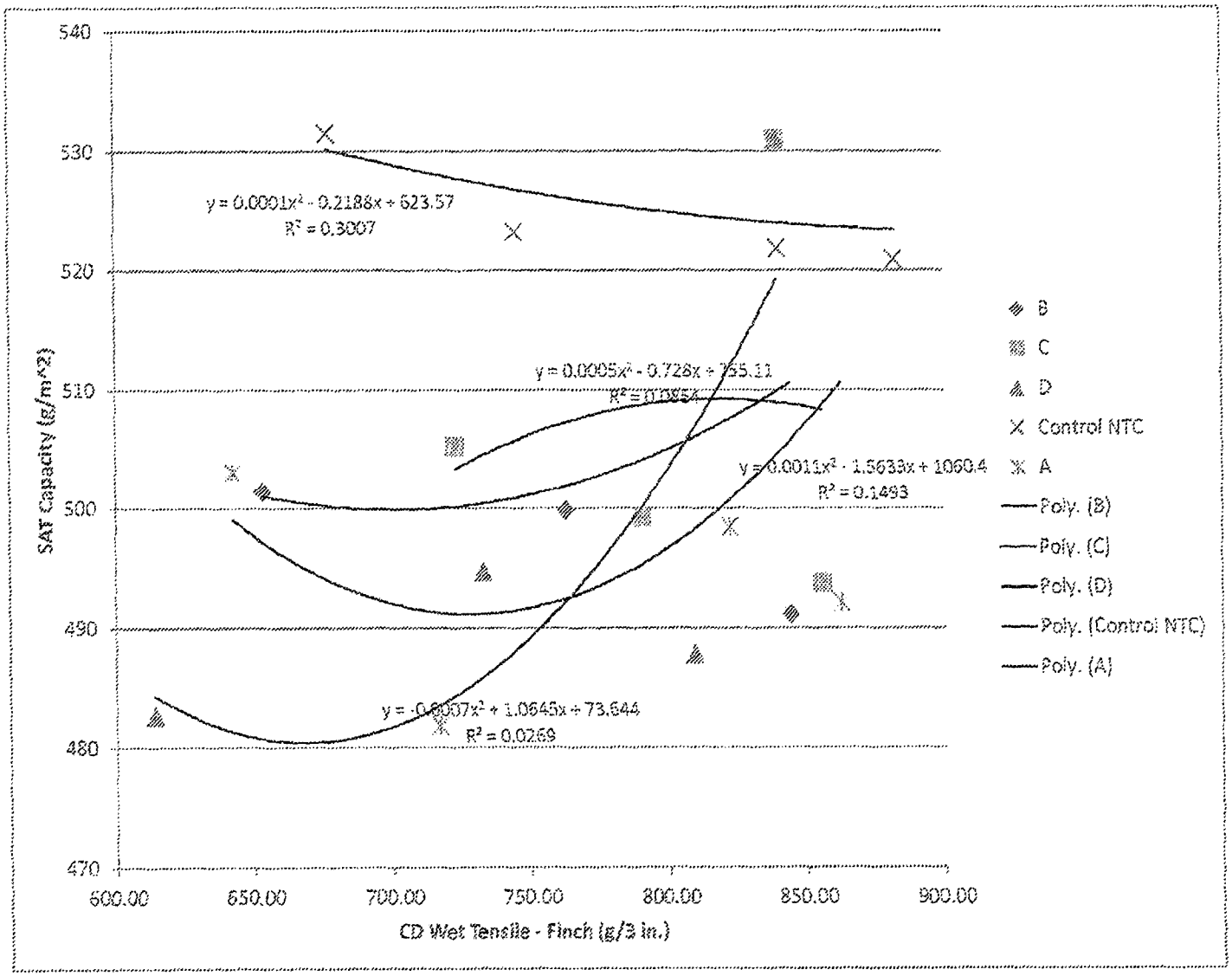
Figure 22:
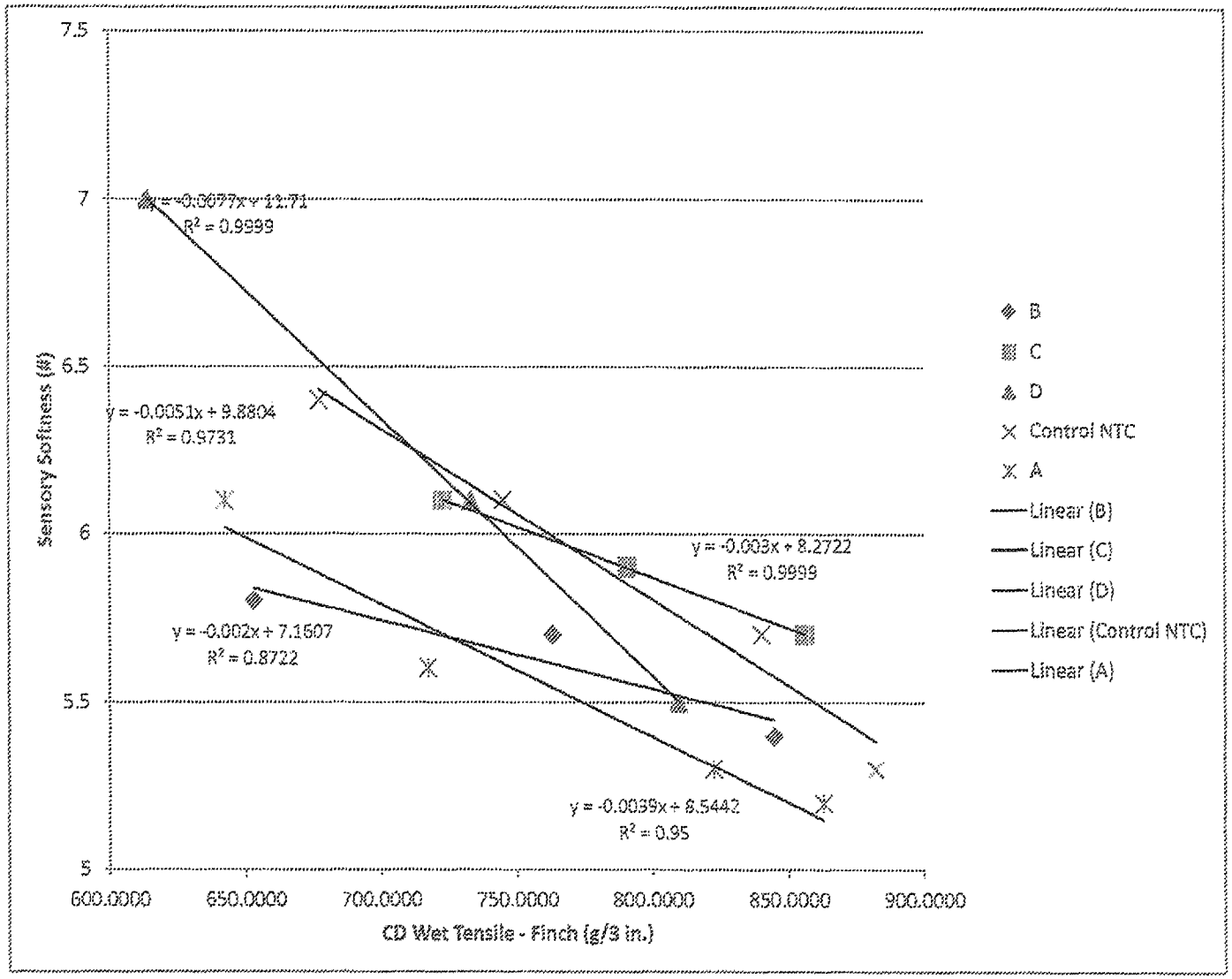

FIG. 1A illustrates one pattern that may be used in the method of the present disclosure to reduce the bulk of the paper product. This pattern is made up of linear segments that are curved and flow around each other in a swirling pattern. FIG. 1B illustrates the pattern of FIG. 1A as it would be represented by dot embossments. FIGS. 2A, 3A, 4A, 5A, 6A, 7A and 8A illustrate other patterns that may be used in the method of the present disclosure to reduce the bulk of the paper product. FIGS. 2B, 3B, 4B 5B 6B, 7B and 8B illustrates the same patterns of FIGS. 2A, 3A, 4A, 5A, 6A, 7A and 8A, respectively, as they would be represented by dot embossments. FIG. 9 illustrates a pattern for use in the instant invention where the pattern is made up of linear segments of differing sizes.

As used herein, "about" is meant to account for variations due to experimental error. All measurements are understood to be modified by the word "about", whether or not "about" is explicitly recited, unless specifically stated otherwise. Thus, for example, the statement "an emboss depth of at least 30 mils" is understood to mean "an emboss depth of at least about 30 mils."

The details of one or more non-limiting embodiments of the invention are set forth in the examples below. Other embodiments of the invention should be apparent to those of ordinary skill in the art after consideration of the present disclosure.

EXAMPLES

The product characteristics measured in the Examples, infra, were measured according the following methodologies. Throughout this specification and claims, it is to be understood that, unless otherwise specified, physical properties are measured after the web has been conditioned according to Technical Association of the Pulp and Paper Industry (TAPPI) standards. If no test method is explicitly set forth for measurement of any quantity mentioned herein, it is to be understood that TAPPI standards should be applied.

Basis Weight

Unless otherwise specified, "basis weight", BWT, bwt, BW, and so forth, refers to the weight of a 3000 square-foot ream of product (basis weight is also expressed in g/m$^2$ or gsm). Likewise, "ream" means a 3000 square-foot ream, unless otherwise specified. Likewise, percent or like terminology refers to weight percent on a dry basis, that is to say, with no free water present, which is equivalent to 5% moisture in the fiber.

Caliper

Calipers and/or bulk reported herein may be measured at 8 or 16 sheet calipers as specified. The sheets are stacked and the caliper measurement taken about the central portion of the stack. Preferably, the test samples are conditioned in an atmosphere of 230±1.0° C. (73.40±1.8° F.) at 50% relative humidity for at least about 2 hours and then measured with a Thwing-Albert Model 89-II-JR or Progage Electronic Thickness Tester with 2-in diameter anvils, 539±10 grams dead weight load, and 0.231 in/sec descent rate. For finished product testing, each sheet of product to be tested must have the same number of plies as the product as sold. For testing in general, eight sheets are selected and stacked together. For napkin testing, napkins are unfolded prior to stacking. For base sheet testing off of winders, each sheet to be tested must have the same number of plies as produced off of the winder. For base sheet testing off of the papermachine reel, single plies must be used. Sheets are stacked together aligned in the machine direction (MD). Bulk may also be expressed in units of volume/weight by dividing caliper by basis weight.

MD and CD Tensile Stretch, Break Modulus and TEA

Dry tensile strengths (MD and CD), stretch, ratios thereof, modulus, break modulus, stress and strain are measured with a standard Instron test device or other suitable elongation tensile tester, which may be configured in various ways, typically, using 3 inch or 1 inch wide strips of tissue or towel, conditioned in an atmosphere of 23°±1° C. (73.40±1° F.) at 50% relative humidity for 2 hours. The tensile test is run at a crosshead speed of 2 in/min. Break modulus is expressed in grams/3 inches/% strain or its SI equivalent of g/mm/% strain. % strain is dimensionless and need not be specified. Unless otherwise indicated, values are break values. GM refers to the square root of the product of the MD and CD values for a particular product. Tensile energy absorption (TEA), which is defined as the area under the load/elongation (stress/strain) curve, is also measured during the procedure for measuring tensile strength. Tensile energy absorption is related to the perceived strength of the product in use. Products having a higher TEA may be perceived by users as being stronger than similar products that have lower TEA values, even if the actual tensile strength of the two products are the same. In fact, having a higher tensile energy absorption may allow a product to be perceived as being stronger than one with a lower TEA, even if the tensile strength of the high-TEA product is less than that of the product having the lower TEA. When the term "normalized" is used in connection with a tensile strength, it simply refers to the appropriate tensile strength from which the effect of basis weight has been removed by dividing that tensile strength by the basis weight. In many cases, similar information is provided by the term "breaking length".

GMT refers to the geometric mean tensile strength of the CD and MD tensile. Tensile energy absorption (TEA) is measured in accordance with TAPPI test method T494 om-01.

Tensile ratios are simply ratios of an MD value determined by way of the foregoing methods divided by the corresponding CD value. Unless otherwise specified, a tensile property is a dry sheet property.

Perforation Tensile

The perforation tensile strength (force per unit width required to break a specimen) is measured generally using a constant rate of elongation tensile tester equipped with 3-in wide jaw line contact grips. Typically, the test is carried out using 3 inch wide by 5 inch long strips of tissue or towel, conditioned in an atmosphere of 23° 1.0° C. (73.4°±1.8° F.) at 50% relative humidity for 2 hours. The crosshead speed of the tensile tester is generally set to 2.0 in. per minute. The jaw span is 3 inches. The specimen is clamped into the upper grip and allowed to hang freely. The lower grip is then used to grip the free end of the specimen tightly enough to hold the sample, but not with sufficient pressure to damage the sample. The sample is stretched until it breaks and the perforation tensile is recorded.

Wet Tensile

The wet tensile of the tissue of the present invention is measured generally following TAPPI Method T 576 pm 7, using a three-inch (76.2 mm) wide strip of tissue that is folded into a loop, clamped in a special fixture termed a Finch Cup, then immersed in water. A suitable Finch cup, 3-in., with base to fit a 3-in. grip, is available from:

High-Tech Manufacturing Services, Inc.
3105-B NE 65$^{th}$ Street
Vancouver, Wash. 98663
360-696-1611
360-696-9887 (FAX).

For fresh basesheet and finished product (aged 30 days or less for towel product, aged 24 hours or less for tissue product) containing wet strength additive, the test specimens are placed in a forced air oven heated to 105° C. (221° F.) for five minutes. No oven aging is needed for other samples. The Finch cup is mounted onto a tensile tester equipped with a 2.0 pound load cell with the flange of the Finch cup clamped by the tester's lower jaw and the ends of tissue loop clamped into the upper jaw of the tensile tester. The sample is immersed in water that has been adjusted to a pH of 7.0±0.1 and the tensile is tested after a 5 second immersion time using a crosshead speed of 2 inches/minute. The results are expressed in g/3 in., dividing the readout by two to account for the loop as appropriate.

Roll Compression

Roll compression is measured by compressing a roll under a 1500 g flat platen of a test apparatus. Sample rolls are conditioned and tested in an atmosphere of 23.0°±1.0° C. (73.4°±1.8° F.). A suitable test apparatus with a movable 1500 g platen (referred to as a height gauge) is available from:

Research Dimensions
1720 Oakridge Road
Neenah, Wis. 54956
920-722-2289
920-725-6874 (FAX).

The test procedure is generally as follows:

(a) Raise the platen and position the roll to be tested on its side, centered under the platen, with the tail seal to the front of the gauge and the core parallel to the back of the gauge.
(b) Slowly lower the platen until it rests on the roll.
(c) Read the compressed roll diameter or sleeve height from the gauge pointer to the nearest 0.01 inch (0.254 mm).
(d) Raise the platen and remove the roll.
(e) Repeat for each roll or sleeve to be tested.

To calculate roll compression (RC) in percent, the following formula is used:

$$RC(\%) = 100 \times \frac{(\text{initial roll diameter} - \text{compressed roll diameter})}{\text{initial roll diameter}}$$

SAT Capacity

Absorbency of the inventive products is measured with a simple absorbency tester. The simple absorbency tester is a particularly useful apparatus for measuring the hydrophilicity and absorbency properties of a sample of tissue, napkins, or towel. In this test, a sample of tissue, napkins, or towel 2.0 inches in diameter is mounted between a top flat plastic cover and a bottom grooved sample plate. The tissue, napkin, or towel sample disc is held in place by a 1% inch wide circumference flange area. The sample is not compressed by the holder. De-ionized water at 73° F. is introduced to the sample at the center of the bottom sample plate through a 1 mm. diameter conduit. This water is at a hydrostatic head of minus 5 mm. Flow is initiated by a pulse introduced at the start of the measurement by the instrument mechanism. Water is thus imbibed by the tissue, napkin, or towel sample from this central entrance point radially outward by capillary action. When the rate of water imbibition decreases below 0.005 μm water per 5 seconds, the test is terminated. The amount of water removed from the reservoir and absorbed by the sample is weighed and reported as grams of water per square meter of sample or grams of water per gram of sheet. In practice, an M/K Systems Inc. Gravimetric Absorbency Testing System is used. This is a commercial system obtainable from M/K Systems Inc., 12 Garden Street, Danvers, Mass., 01923. WAC, or water absorbent capacity, also referred to as SAT, is actually determined by the instrument itself. WAC is defined as the point where the weight versus time graph has a "zero" slope, i.e., the sample has stopped absorbing. The termination criteria for a test are expressed in maximum change in water weight absorbed over a fixed time period. This is basically an estimate of zero slope on the weight versus time graph. The program uses a change of 0.005 g over a 5 second time interval as termination criteria; unless "Slow SAT" is specified in which case the cut off criteria is 1 mg in 20 seconds.

Water absorbency rate is measured in seconds and is the time it takes for a sample to absorb a 0.1 gram droplet of water disposed on its surface by way of an automated syringe. The test specimens are preferably conditioned at 23° C.±1.0° C. (73.4° F.±1.8° F.) at 50% relative humidity. For each sample, 4 3×3 inch test specimens are prepared. Each specimen is placed in a sample holder such that a high intensity lamp is directed toward the specimen. 0.1 ml of water is deposited on the specimen surface and a stop watch is started. When the water is absorbed, as indicated by lack of further reflection of light from the drop, the stopwatch is stopped and the time recorded to the nearest 0.1 seconds. The procedure is repeated for each specimen and the results averaged for the sample. SAT Rate is determined by graphing the weight of water absorbed by the sample (in grams) against the square root of time (in seconds). The SAT rate is the best fit slope between 10 and 60 percent of the end point (grams of water absorbed).

Sensory Softness

Sensory softness of the samples was determined by using a panel of trained human subjects in a test area conditioned to TAPPI standards (temperature of 71.2° F. to 74.8° F., relative humidity of 48% to 52%). The softness evaluation relied on a series of physical references with predetermined softness values that were always available to each trained subject as they conducted the testing. The trained subjects directly compared test samples to the physical references to determine the softness level of the test samples. The trained subjects assigned a number to a particular paper product, with a higher sensory softness number indicating a higher the perceived softness.

Example 1

Figure 5A:
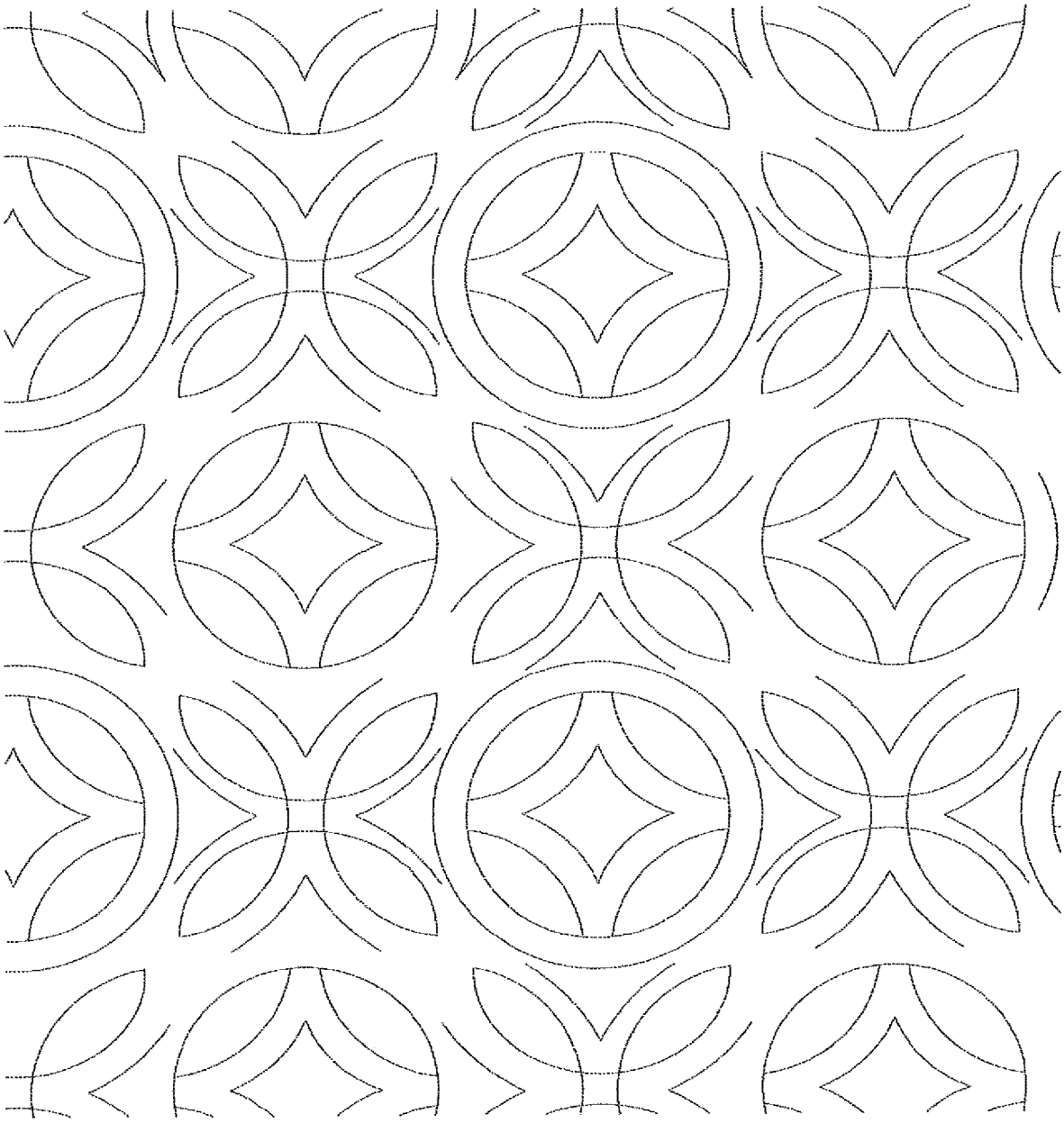
FIGS. 5A and 5B illustrate an emboss pattern that can be used in the method according to the invention, and its counterpart non-linear dot representation, respectively.
Figure 5B:
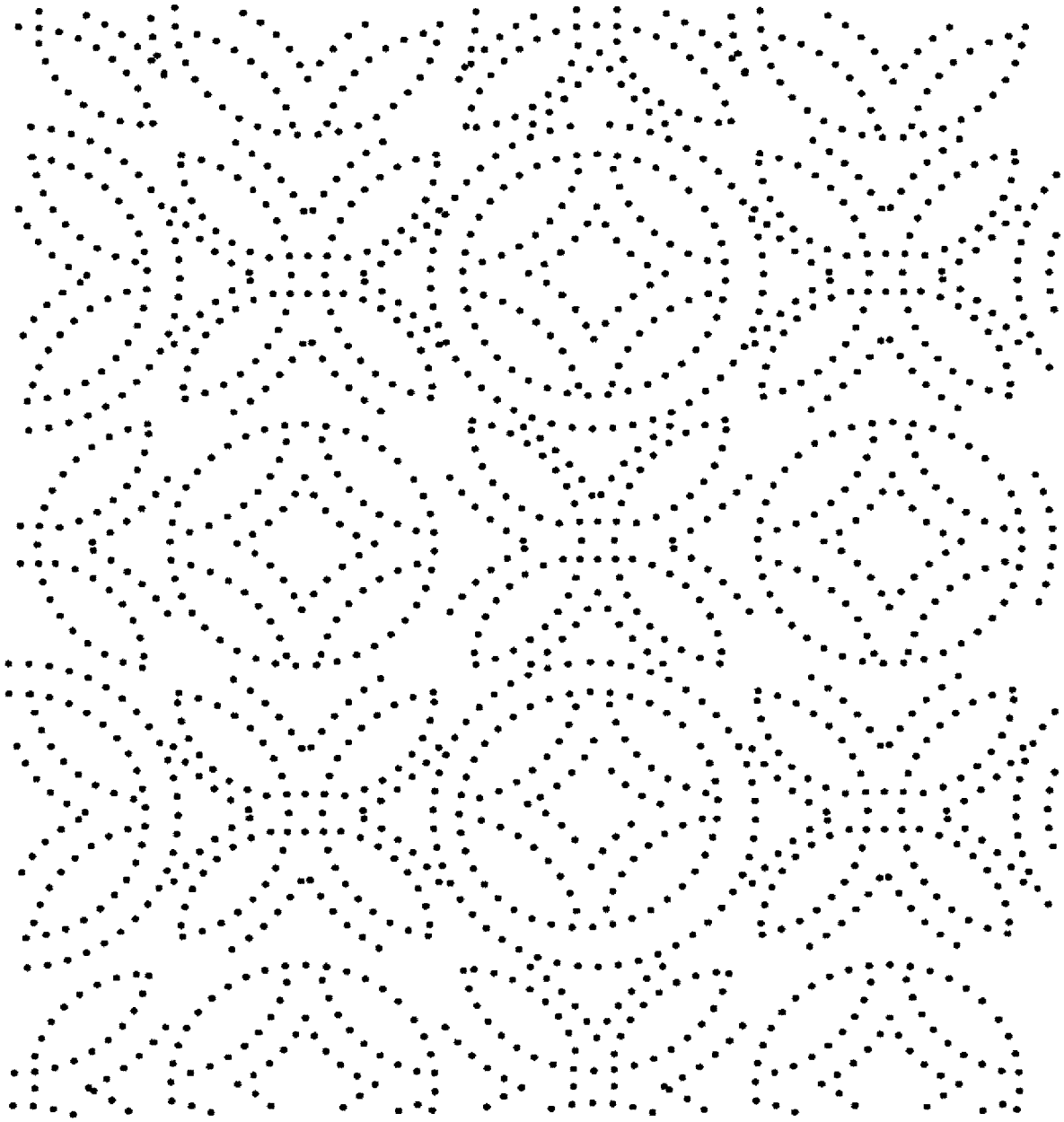
Figure 6A:
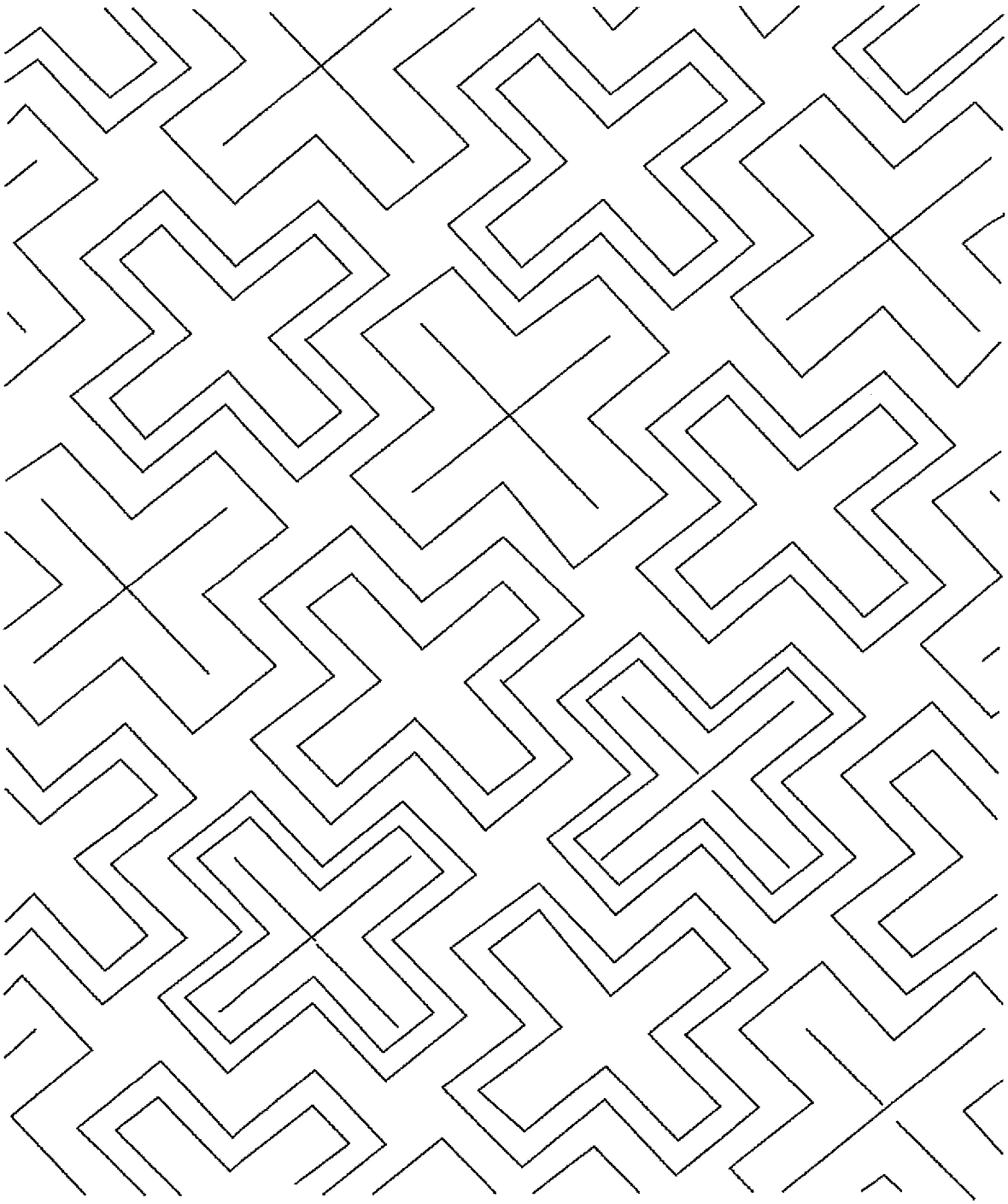
FIGS. 6A and 6B illustrate an emboss pattern that can be used in the method according to the invention, and its counterpart non-linear dot representation, respectively.
Figure 6B:
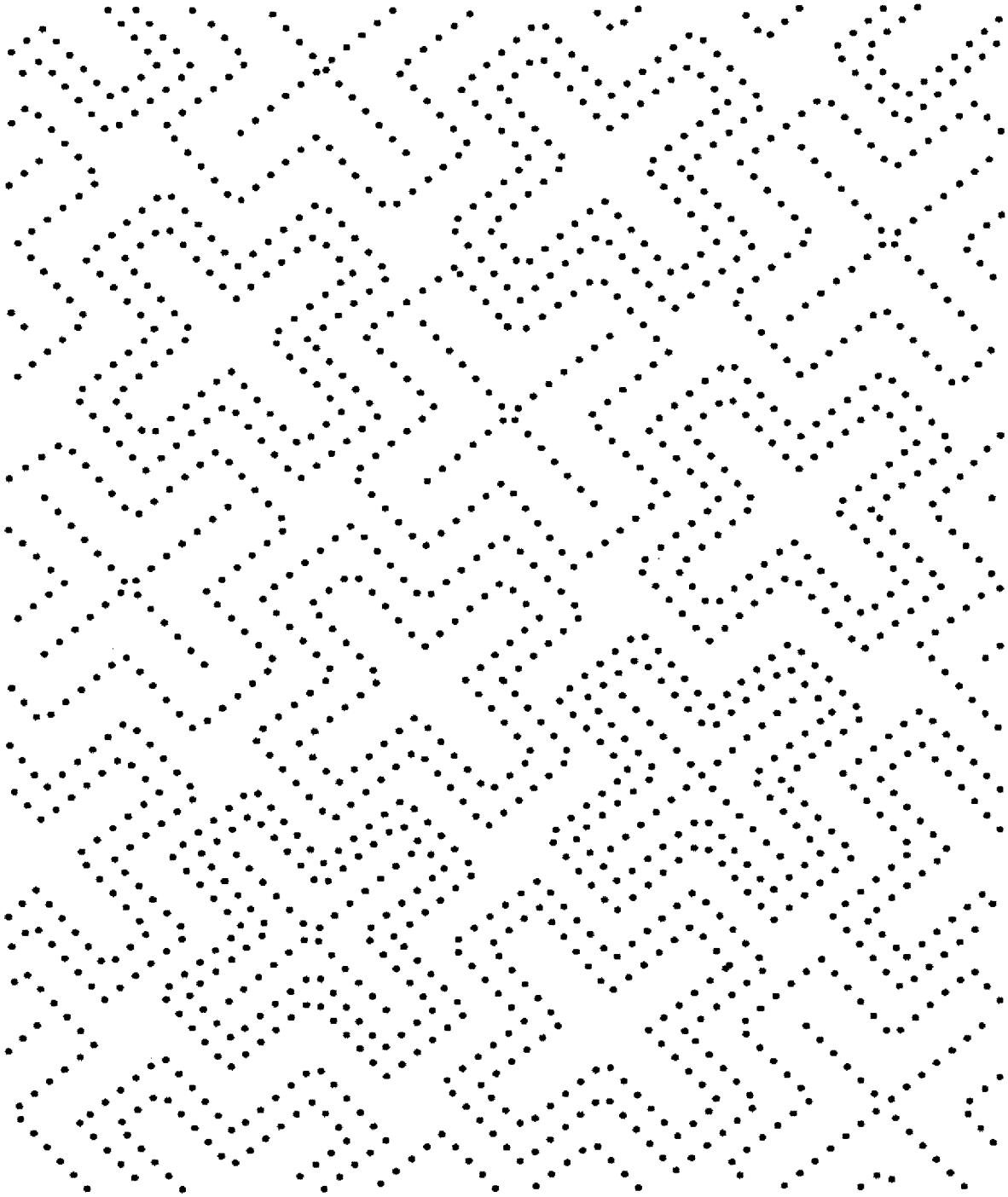
Figure 7A:
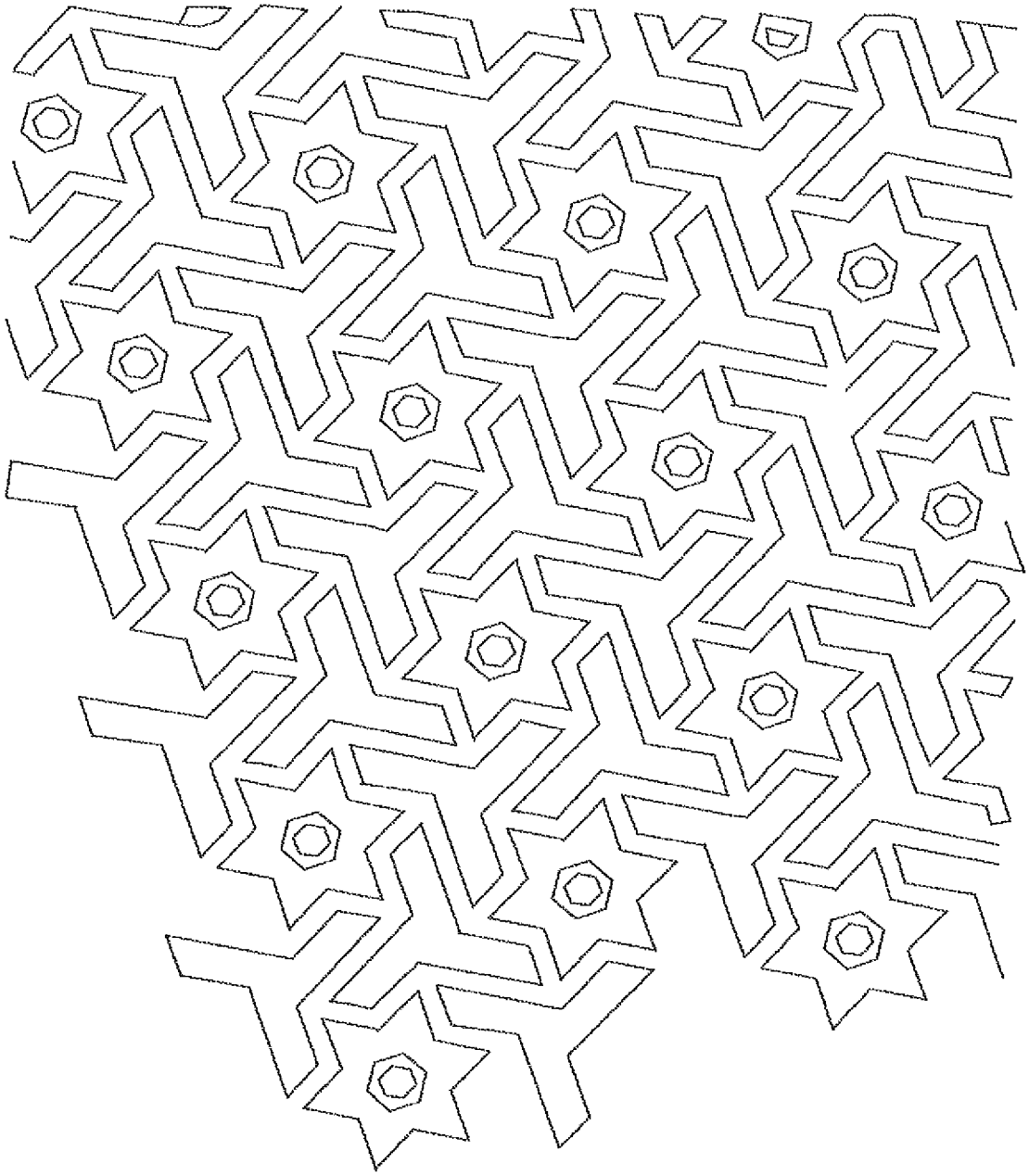
FIGS. 7A and 7B illustrate an emboss pattern that can be used in the method according to the invention, and its counterpart non-linear dot representation, respectively.
Figure 7B:
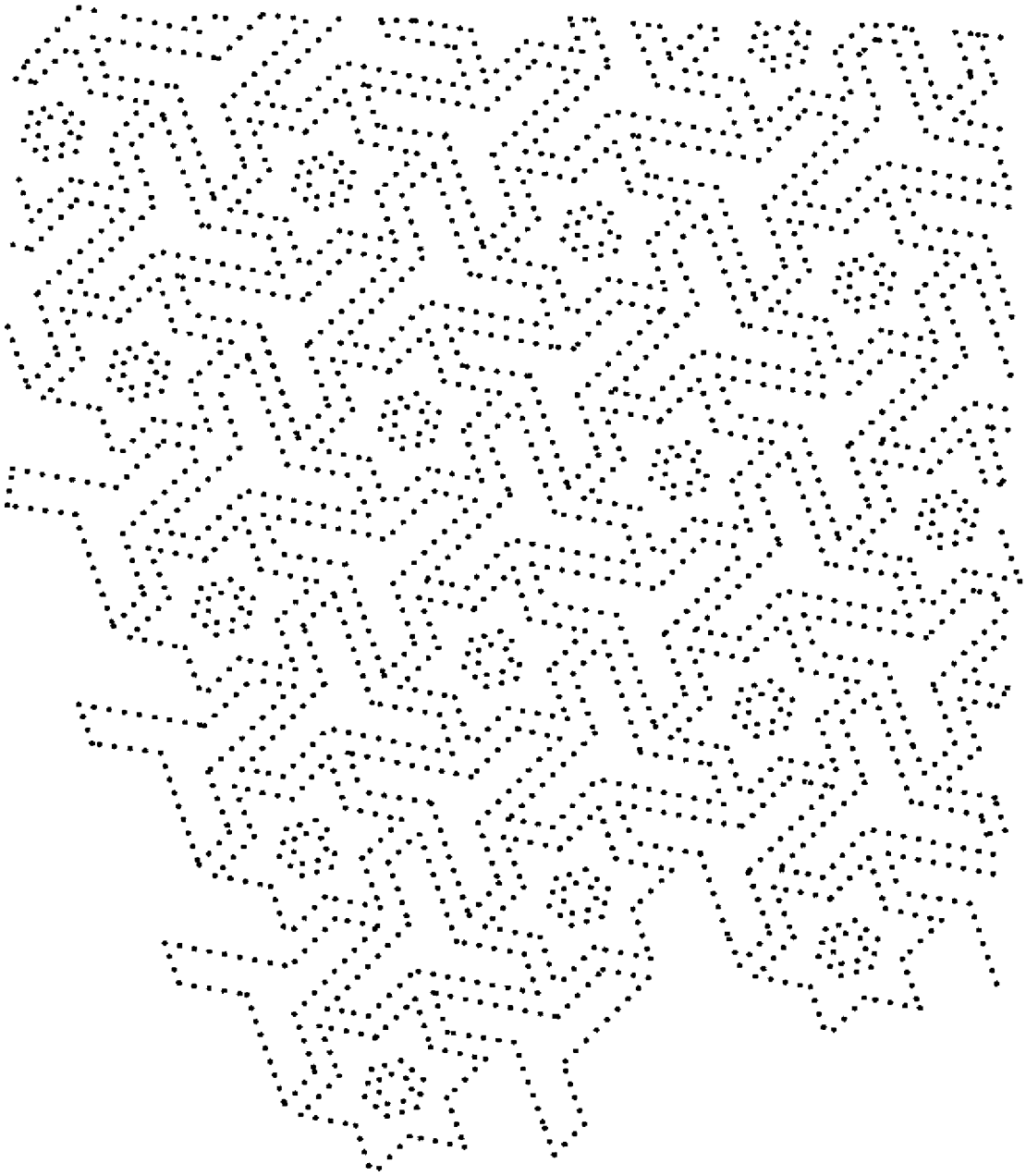
Figure 8A:
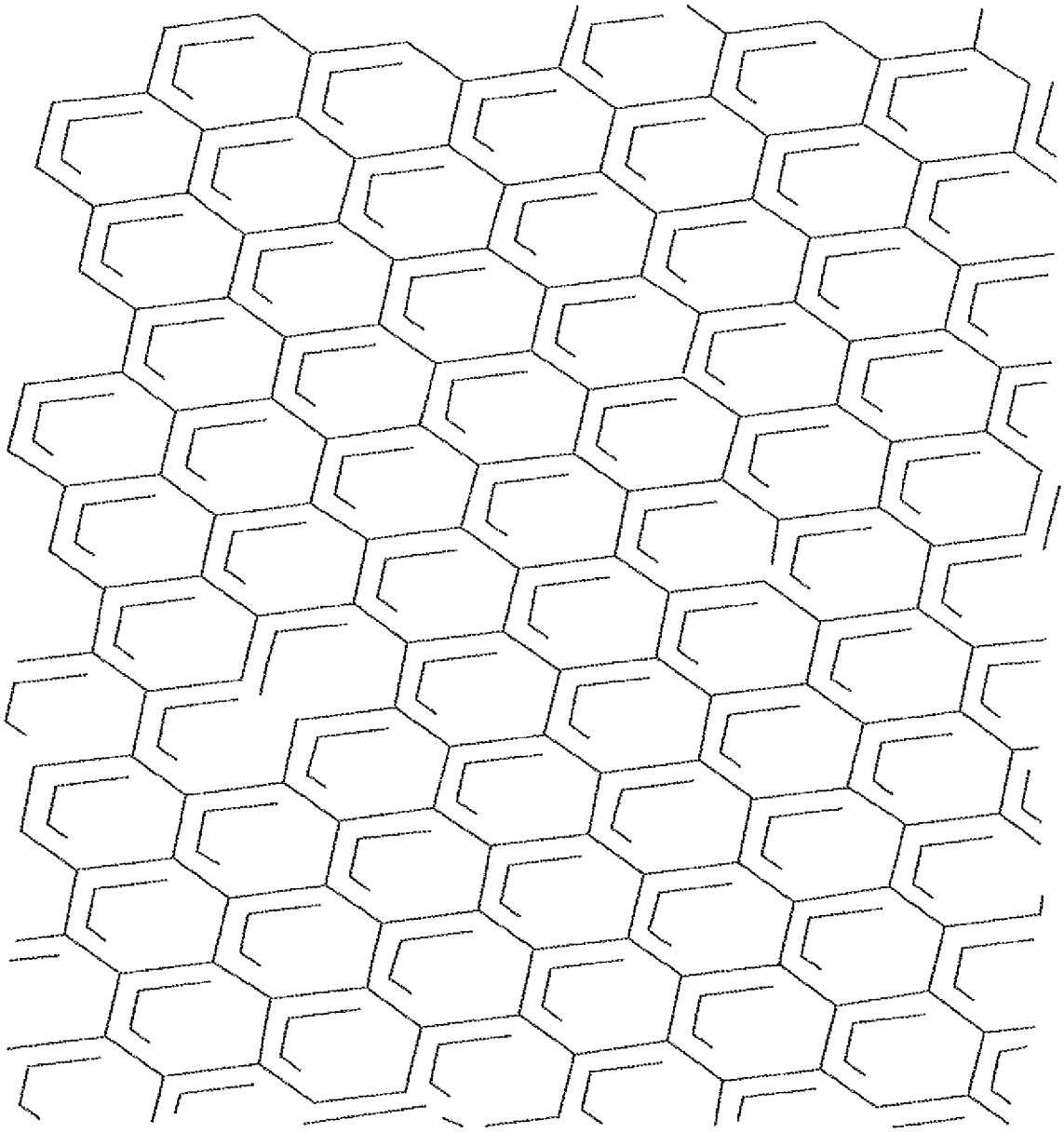
FIGS. 8A and 8B illustrate an emboss pattern that can be used in the method according to the invention, and its counterpart non-linear dot representation, respectively.
Figure 8B:
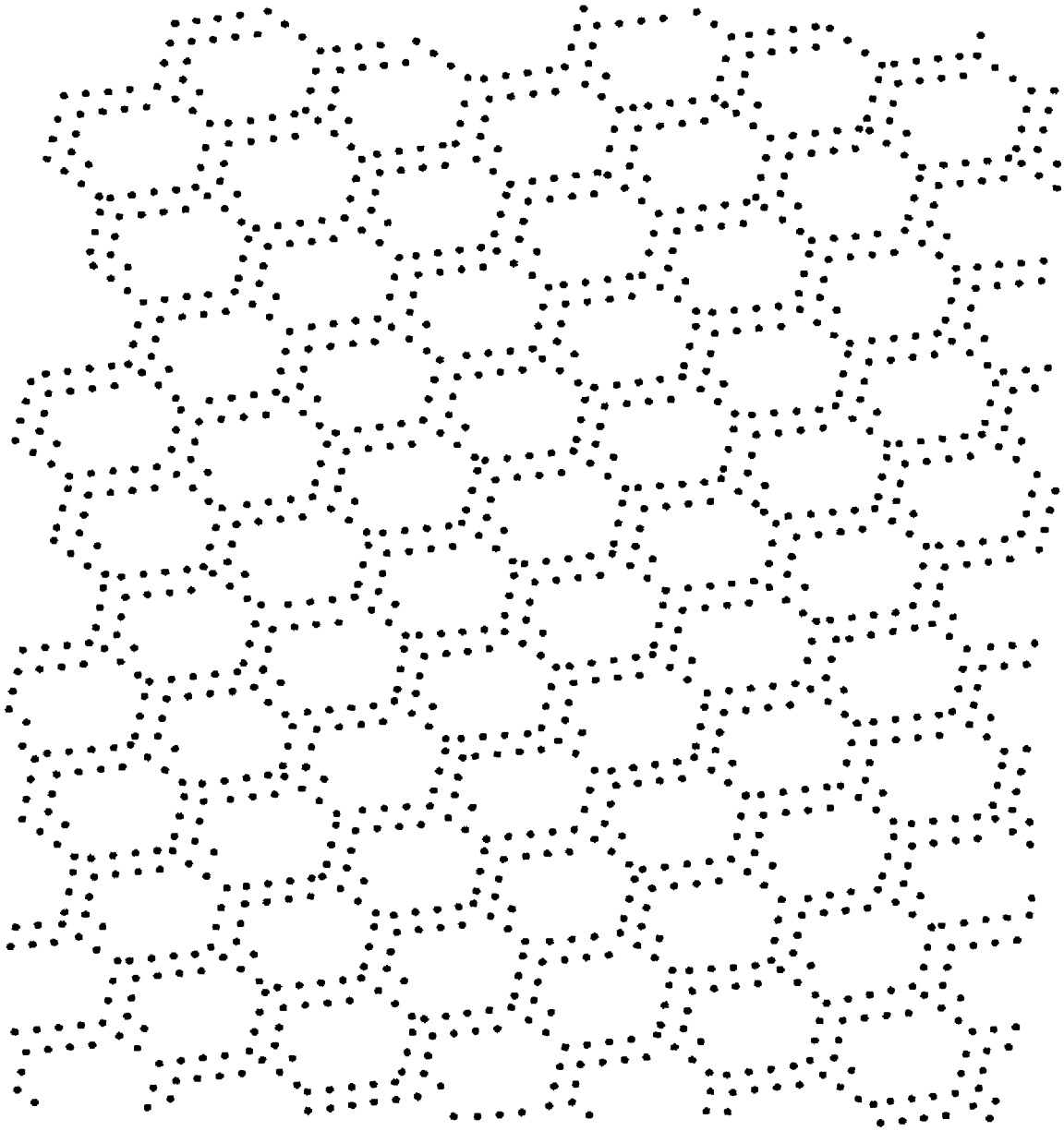

Paper towel base sheets were produced in a consistent manner and were either unembossed or embossed with either the current Brawny® non-linear embossing pattern of FIG. 5B or a linear pattern according to the present invention, i.e., the pattern of FIG. 5A and variations thereof. The characteristics for the unembossed base sheets and the two ply product are set forth in Table 2, below.

Table 3 sets forth the product characteristics for an embossed paper towel product bearing the current commercial, non-linear embossing pattern, both at a commercial emboss depth and at a depth of 45 mils. In Column 3 of Table 3 a comparison is made between the 45 mils embossed product and the unembossed base sheet described in Table 2. As can be seen from Table 3, column 3, the caliper of the product increased with embossing by 6.22%. The Wet Tensile strength remained largely unaffected.

Table 4 sets forth finished product characteristics for four paper towel products embossed with linear patterns according to the instant method. Table 5 compares those embossed product characteristics to the unembossed base sheet of Table 2. As can be seen in Table 5, when a paper towel was embossed with a substantially linear pattern as described herein, the caliper of the two ply product was less than the caliper of the two base sheets. As can also be seen from Table 5, the impact on sheet strength was minimal, if negative. In two instances, the CD wet tensile increased. Finally, while the absorbency of the final product did go down, the change in absorbency as reflected by the SAT capacity was always less than 10% and in some instances less than 5%. Accordingly, in this embodiment, an embossed paper product results having a lower caliper and higher density than the original base sheets and a significantly lower caliper than paper products embossed with a traditional non-linear pattern. In addition, the lower caliper and higher density do not result in changes in strength or sensory softness and only exhibit minor losses in absorbency.

TABLE 2

| Description | Ply 1 | Ply 2 | Combined Base Sheet |
|---|---|---|---|
| Basis Weight lb/3000 $ft^2$ | 13.55 | 13.45 | 27.00 |
| Caliper 8 Sheetmils/8 sht | 89.2 | 92.7 | 181.9 |
| Tensile MD g/3 in | 1385.18 | 1569.31 | 2954.49 |
| Stretch MD % | 15.48 | 16.76 | 16.12 |
| Tensile CD g/3 in. | 1456.36 | 1478.55 | 2943.92 |
| Stretch CD % | 8.76 | 9.30 | 9.03 |
| Tensile GM g/3 in. | 1424.06 | 1522.78 | 2946.84 |
| Tensile Dry Ratio Unitless | 0.95 | 1.06 | 1.00 |
| Perf Tensile g/3 in. | | | |
| Wet Tens Finch Cured CD g/3 in. | 424.63 | 415.16 | 839.78 |
| Tensile Wet/Dry CD Unitless | 0.29 | 0.28 | 0.29 |

TABLE 2-continued

| Description | Ply 1 | Ply 2 | Combined Base Sheet |
|---|---|---|---|
| SAT Capacity g/$m^2$ | | | |
| SAT Rate g/$s^{0.5}$ | | | |
| SAT Times | | | |
| Break Modulus MD gms/% | 88.16 | 92.48 | 180.64 |
| Break Modulus CD gms/% | 169.89 | 158.09 | 327.98 |
| Break Modulus GM gms/% | 122.38 | 120.91 | 243.29 |
| Modulus MD g/% Stretch | | | |
| Modulus CD g/% Stretch | | | |
| Modulus GM g/% Stretch | | | |
| TEA MD mm-g/$mm^2$ | 1.37 | 1.62 | 2.99 |
| TEA CD mm-g/$mm^2$ | 0.81 | 0.88 | 1.69 |
| Roll Diameter In. | | | |
| Roll Compression Value % | | | |
| Roll Compression in. | | | |
| Basis Weight Raw Wtg. | 1.02 | 1.02 | 2.04 |
| Sensory Softness | | | 5.4 |

TABLE 3

| Description | Current Product | Current Product at a penetration of 45 mils | Change from Basesheet based on 45 mils penetration |
|---|---|---|---|
| Basis Weight lb/3000 $ft^2$ | 26.57 | 26.29 | −2.63 |
| Caliper 8 Sheetmils/8 sht | 195.05 | 193.22 | 6.22 |
| Tensile MD g/3 in | 3083.12 | 3228.73 | 5.90 |
| Stretch MD % | 16.68 | 16.57 | 2.80 |
| Tensile CD g/3 in. | 2837.73 | 2903.75 | −1.36 |
| Stretch CD % | 10.03 | 10.04 | 11.18 |
| Tensile GM g/3 in. | 2957.68 | 3013.46 | 2.26 |
| Tensile Dry Ratio Unitless | 1.09 | 1.08 | 0.08 |
| Perf Tensile g/3 in. | 732.25 | 725.78 | |
| Wet Tens Finch Cured CD g/3 in. | 813.27 | 840.26 | 0.06 |
| Tensile Wet/Dry CD Unitless | 0.29 | 0.29 | 0.0 |
| SAT Capacity g/$m^2$ | 512.24 | 521.83 | −1.72 |
| SAT Rate g/$s^{0.5}$ | 0.26 | 0.31 | |
| SAT Times | 42.03 | 35.31 | |
| Break Modulus MD gms/% | 184.92 | 188.78 | 4.51 |
| Break Modulus CD gms/% | 282.17 | 286.38 | −12.69 |
| Break Modulus GM gms/% | 228.39 | 232.47 | −4.45 |
| Modulus MD g/% Stretch | 41.55 | 42.65 | |
| Modulus CD g/% Stretch | 65.35 | 67.85 | |
| Modulus GM g/% Stretch | 52.08 | 53.78 | |
| TEA MD mm-g/$mm^2$ | 3.13 | 3.17 | 6.10 |
| TEA CD mm-g/$mm^2$ | 1.84 | 1.89 | 11.64 |
| Roll Diameter In. | 6.07 | 5.64 | |
| Roll Compression Value % | 3.51 | 3.72 | |
| Roll Compression in. | 5.86 | 5.43 | |
| Basis Weight Raw Wtg. | 2.01 | 1.99 | −2.63 |
| Sensory Softness | 5.60 | 5.7 | |

TABLE 4

| Invention at Penetration of 45 mils | | | | |
|---|---|---|---|---|
| Description | Pattern A | Pattern B | Pattern C | Pattern D |
| Basis Weight lb/3000 $ft^2$ | 26.07 | 26.47 | 26.61 | 26.36 |

TABLE 4-continued

| Invention at Penetration of 45 mils | | | | |
|---|---|---|---|---|
| Description | Pattern A | Pattern B | Pattern C | Pattern D |
| Caliper 8 Sheetmils/8 sht | 178.46 | 180.60 | 179.05 | 175.09 |
| Tensile MD g/3 in | 3000.08 | 3337.16 | 3086.51 | 3161.29 |
| Stretch MD % | 15.55 | 16.07 | 15.83 | 15.38 |
| Tensile CD g/3 in. | 2867.19 | 3185.83 | 2954.76 | 2911.81 |
| Stretch CD % | 9.55 | 9.66 | 9.46 | 9.44 |
| Tensile GM g/3 in. | 2931.82 | 3260.20 | 3019.6 | 3033.45 |
| Tensile Dry Ratio Unitless | 1.05 | 1.05 | 1.04 | 1.09 |
| Perf Tensile g/3 in. | 706.15 | 727.19 | 709.54 | 604.07 |
| Wet Tens Finch Cured CD g/3 in. | 822.45 | 844.51 | 856.00 | 809.51 |
| Tensile Wet/Dry CD Unitless | 0.29 | 0.27 | 0.29 | 0.28 |
| SAT Capacity g/m$^2$ | 498.4 | 491.19 | 493.76 | 487.84 |
| SAT Rate g/s$^{0.5}$ | 0.25 | 0.24 | 0.27 | 0.26 |
| SAT Times | 35.62 | 32.22 | 29.41 | 28.87 |
| Break Modulus MD gms/% | 194.47 | 205.36 | 195.14 | 205.07 |
| Break Modulus CD gms/% | 296.92 | 332.89 | 316.78 | 307.04 |
| Break Modulus GM gms/% | 240.26 | 261.45 | 248.60 | 250.88 |
| Modulus MD g/% Stretch | 45.80 | 50.38 | 45.43 | 49.37 |
| Modulus CD g/% Stretch | 67.96 | 77.77 | 71.27 | 67.81 |
| Modulus GM g/% Stretch | 55.76 | 62.59 | 56.89 | 57.82 |
| TEA MD mm-g/mm$^2$ | 2.90 | 3.44 | 3.08 | 3.02 |
| TEA CD mm-g/mm$^2$ | 1.79 | 2.01 | 1.78 | 1.71 |
| Roll Diameter In. | 5.86 | 5.76 | 5.78 | 5.65 |
| Roll Compression Value % | 4.21 | 5.27 | 5.48 | 4.96 |
| Roll Compression in. | 5.61 | 5.45 | 5.46 | 5.37 |
| Basis Weight Raw Wtg. | 1.97 | 2.00 | 2.01 | 1.99 |
| Sensory Softness | 5.30 | 5.40 | 5.70 | 5.50 |

TABLE 5

| Invention at Penetration of 45 mils (Percent Change from Basesheet) | | | | |
|---|---|---|---|---|
| Description | Pattern A | Pattern B | Pattern C | Pattern D |
| Basis Weight lb/3000 ft$^2$ | −3.45 | −1.94 | −1.45 | −2.36 |
| Caliper 8 Sheetmils/8 sht | −1.89 | −0.71 | −1.57 | −3.74 |
| Tensile MD g/3 in | 1.54 | 12.95 | 4.47 | 7.00 |
| Stretch MD % | −3.52 | −0.31 | −1.81 | −4.61 |
| Tensile CD g/3 in. | −2.61 | 8.22 | 0.37 | −1.09 |
| Stretch CD % | 5.78 | 7.01 | 4.74 | 4.55 |
| Tensile GM g/3 in. | −0.51 | 10.63 | 2.47 | 2.94 |
| Tensile Dry Ratio Unitless | 5.00 | 5.00 | 4.00 | 9.00 |
| Perf Tensile g/3 in. | | | | |
| Wet Tens Finch Cured CD g/3 in. | −2.06 | 0.56 | 1.93 | −3.61 |
| Tensile Wet/Dry CD Unitless | 0.00 | −7.06 | 0.00 | −3.50 |
| SAT Capacity g/m$^2$ | −6.13 | −7.49 | −7.01 | −8.12 |
| SAT Rate g/s$^{0.5}$ | | | | |
| SAT Times | | | | |
| Break Modulus MD gms/% | 7.66 | 13.69 | 8.03 | 13.53 |
| Break Modulus CD gms/% | −9.47 | 1.49 | −3.41 | −6.39 |
| Break Modulus GM gms/% | −1.25 | 7.46 | 2.18 | 3.12 |
| Modulus MD g/% Stretch | | | | |
| Modulus CD g/% Stretch | | | | |
| Modulus GM g/% Stretch | | | | |
| TEA MD mm-g/mm$^2$ | −2.77 | 15.32 | 3.00 | 1.18 |
| TEA CD mm-g/mm$^2$ | 5.91 | 18.95 | 5.50 | 1.49 |
| Roll Diameter In. | | | | |
| Roll Compression Value % | | | | |
| Roll Compression in. | | | | |
| Basis Weight Raw Wtg. | −3.45 | −1.94 | −1.45 | −2.36 |
| Sensory Softness | | | | |

Example 2

Example 2 was carried out in the same manner as Example 1, using an emboss penetration of 55 mils. Results are set forth in Tables 6-8, below.

TABLE 6

| Description | Current Product | Current Product at a penetration of 55 mils | Change from Basesheet based on 55 mils penetration |
|---|---|---|---|
| Basis Weight lb/3000 ft$^2$ | 26.57 | 26.36 | −2.38 |
| Caliper 8 Sheetmils/8 sht | 195.05 | 206.23 | 13.37 |
| Tensile MD g/3 in | 3083.12 | 2865.60 | −3.01 |
| Stretch MD % | 16.68 | 16.84 | 4.49 |
| Tensile CD g/3 in. | 2837.73 | 2611.43 | −11.29 |
| Stretch CD % | 10.03 | 10.22 | 13.18 |
| Tensile GM g/3 in. | 2957.68 | 2735.26 | −7.18 |
| Tensile Dry Ratio Unitless | 1.09 | 1.10 | 10.0 |
| Perf Tensile g/3 in. | 732.25 | 667.89 | |
| Wet Tens Finch Cured CD g/3 in. | 813.27 | 744.95 | −11.29 |
| Tensile Wet/Dry CD Unitless | 0.29 | 0.29 | 0.00 |
| SAT Capacity g/m$^2$ | 512.24 | 523.31 | −1.72 |
| SAT Rate g/s$^{0.5}$ | 0.26 | 0.33 | |
| SAT Times | 42.03 | 40.09 | |
| Break Modulus MD gms/% | 184.92 | 170.36 | −5.69 |
| Break Modulus CD gms/% | 282.17 | 253.72 | −22.64 |
| Break Modulus GM gms/% | 228.39 | 207.88 | −14.55 |
| Modulus MD g/% Stretch | 41.55 | 37.07 | |
| Modulus CD g/% Stretch | 65.35 | 57.73 | |
| Modulus GM g/% Stretch | 52.08 | 46.24 | |
| TEA MD mm-g/mm$^2$ | 3.13 | 2.91 | −2.58 |
| TEA CD mm-g/mm$^2$ | 1.84 | 1.74 | 3.29 |
| Roll Diameter In. | 6.07 | 5.90 | |
| Roll Compression Value % | 3.51 | 4.80 | |
| Roll Compression in. | 5.86 | 5.62 | |
| Basis Weight Raw Wtg. | 2.01 | 1.99 | −2.38 |
| Sensory Softness | 5.60 | 6.1 | |

TABLE 7

| Invention at Penetration of 55 mils | | | | |
|---|---|---|---|---|
| Description | Pattern A | Pattern B | Pattern C | Pattern D |
| Basis Weight lb/ 3000 $ft^2$ | 26.12 | 26.19 | 26.40 | 26.18 |
| Caliper 8 Sheetmils/8 sht | 183.32 | 192.26 | 187.54 | 187.61 |
| Tensile MD g/3 in | 2793.50 | 2966.23 | 2880.07 | 2864.20 |
| Stretch MD % | 15.23 | 15.90 | 15.30 | 14.87 |
| Tensile CD g/3 in. | 2492.66 | 2688.85 | 2723.01 | 2501.79 |
| Stretch CD % | 9.58 | 9.52 | 9.50 | 8.97 |
| Tensile GM g/3 in. | 2638.12 | 2823.32 | 2799.58 | 2676.19 |
| Tensile Dry Ratio Unitless | 1.12 | 1.10 | 1.06 | 1.15 |
| Perf Tensile g/3 in. | 624.56 | 682.48 | 647.34 | 704.59 |
| Wet Tens Finch Cured CD g/3 in. | 717.31 | 762.97 | 790.76 | 733.06 |
| Tensile Wet/Dry CD Unitless | 0.29 | 0.28 | 0.29 | 0.29 |
| SAT Capacity g/$m^2$ | 481.81 | 499.80 | 499.30 | 494.75 |
| SAT Rate g/$s^{0.5}$ | 0.20 | 0.26 | 0.26 | 0.28 |
| SAT Times | 44.07 | 31.98 | 29.71 | 26.31 |
| Break Modulus MD gms/% | 183.24 | 185.48 | 187.84 | 192.75 |
| Break Modulus CD gms/% | 259.48 | 279.78 | 285.78 | 279.27 |
| Break Modulus GM gms/% | 218.00 | 227.76 | 231.67 | 231.94 |
| Modulus MD g/% Stretch | 46.40 | 42.64 | 42.75 | 42.76 |
| Modulus CD g/% Stretch | 64.30 | 63.57 | 64.38 | 61.86 |
| Modulus GM g/% Stretch | 54.59 | 52.04 | 52.43 | 51.39 |
| TEA MD mm-g/$mm^2$ | 2.67 | 2.94 | 2.72 | 2.62 |
| TEA CD mm-g/$mm^2$ | 1.55 | 1.62 | 1.63 | 1.41 |
| Roll Diameter In. | 6.03 | 6.03 | 5.98 | 6.04 |
| Roll Compression Value % | 4.59 | 6.63 | 6.41 | 6.90 |
| Roll Compression in. | 5.75 | 5.63 | 5.60 | 5.63 |
| Basis Weight Raw Wtg. | 1.97 | 1.98 | 2.00 | 1.98 |
| Sensory Softness | 5.60 | 5.70 | 5.90 | 6.10 |

TABLE 8

| Invention at Penetration of 55 mils (Percent Change from Basesheet) | | | | |
|---|---|---|---|---|
| Description | Pattern A | Pattern B | Pattern C | Pattern D |
| Basis Weight lb/ 3000 $ft^2$ | −3.24 | −3.00 | −2.20 | −3.05 |
| Caliper 8 Sheetmils/8 sht | 0.78 | 5.69 | 3.10 | 3.14 |
| Tensile MD g/3 in | −5.45 | 0.40 | −2.52 | −3.06 |
| Stretch MD % | −5.51 | −1.35 | −5.10 | −7.78 |
| Tensile CD g/3 in. | −15.33 | −8.66 | −7.50 | −15.02 |
| Stretch CD % | 6.07 | 5.44 | 5.18 | −0.63 |
| Tensile GM g/3 in. | −10.48 | −4.19 | −5.00 | −9.18 |
| Tensile Dry Ratio Unitless | 12.30 | 10.00 | 6.00 | 15.00 |
| Perf Tensile g/3 in. | | | | |
| Wet Tens Finch Cured CD g/3 in. | −14.58 | −9.15 | −5.84 | −12.71 |
| Tensile Wet/Dry CD Unitless | 0.0 | −3.5 | 0.0 | 0.0 |
| SAT Capacity g/$m^2$ | | | | |
| SAT Rate g/$s^{0.5}$ | | | | |
| SAT Times | | | | |
| Break Modulus MD gms/% | 1.44 | 2.68 | 3.99 | 6.70 |
| Break Modulus CD gms/% | −20.89 | −14.70 | −12.87 | −14.85 |
| Break Modulus GM gms/% | −10.40 | −6.38 | −4.78 | −4.67 |
| Modulus MD g/% Stretch | | | | |
| Modulus CD g/% Stretch | | | | |
| Modulus GM g/% Stretch | | | | |
| TEA MD mm-g/$mm^2$ | −10.50 | −1.62 | −9.00 | −12.21 |
| TEA CD mm-g/$mm^2$ | −8.44 | −3.90 | −3.70 | −16.75 |
| Roll Diameter In. | | | | |
| Roll Compression Value % | | | | |
| Roll Compression in. | | | | |
| Basis Weight Raw Wtg. | −3.24 | −3.00 | −2.20 | −3.05 |
| Sensory Softness | | | | |

The graphs presented in FIGS. 10 to 22 represent the outcome of Example 2 compared directly to the current product.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A paper product comprising, at least one paper web having an embossed surface wherein the emboss pattern is made up of at least about 80% linear elements and the emboss depth is from about 1.25 to about 3.5 times the caliper of the unembossed at least one web; and wherein the finished product has a caliper at least 2% less than the same pattern formed from dots; and a tensile dry ratio, MD:CD, of 1.15 or less.

2. The product of claim 1, wherein the emboss pattern covers 22 to 50% of the paper web.

3. The product of claim 1, wherein the emboss pattern covers 25 to 30% of the paper web.

4. The product of claim 1, wherein the emboss pattern includes at least about 90% linear embossments.

5. The product of claim 1, wherein the emboss pattern includes at least about 95% linear embossments.

6. The product of claim 1, wherein the emboss pattern includes 100% linear embossments.

7. The product of claim 1, wherein the depth of the embossments are from about 1.5 to about 2.5 times the caliper of the unembossed at least one web.

8. The product of claim 1, wherein the depth of the embossments are from about 1.5 to about 2.0 times the caliper of the unembossed at least one web.

9. A paper product comprising, at least one paper web having an embossed surface wherein the emboss pattern is made up of at least about 80% linear elements and the emboss depth is from about 1.25 to about 3.5 times the caliper of the unembossed at least one web; and wherein the finished product has a CD tensile strength no more than 15% less than the CD tensile strength of the unembossed at least one web.

10. The product of claim 9, wherein the emboss pattern covers 22 to 50% of the paper web.

11. The product of claim 9, wherein the emboss pattern covers 25 to 30% of the paper web.

12. The product of claim 9, wherein the emboss pattern includes at least about 90% linear embossments.

13. The product of claim 9, wherein the emboss pattern includes at least about 95% linear embossments.

14. The product of claim 9, wherein the emboss pattern includes 100% linear embossments.

15. The product of claim 9, wherein the depth of the embossments are from about 1.5 to about 2.5 times the caliper of the unembossed at least one web.

16. The product of claim 9, wherein the depth of the embossments are from about 1.5 to about 2.0 times the caliper of the unembossed at least one web.

17. A paper product comprising, at least one paper web having an embossed surface wherein the emboss pattern is made up of at least about 80% linear elements and the emboss depth is from about 1.25 to about 3.5 times the caliper of the unembossed at least one web; and wherein the finished product has a caliper at least 2% less than the same pattern formed from dots, a tensile dry ratio, MD:CD, of 1.15 or less, and wherein the finished product has a CD tensile strength no more than 15% less than the CD tensile strength of the unembossed at least one web.

* * * * *